US005539509A

United States Patent [19]

Tomoe et al.

[11] Patent Number: 5,539,509

[45] Date of Patent: Jul. 23, 1996

[54] SHEET TRANSPORTATION SYSTEM IN MAGNETIC-TONER XEROGRAPHIC IMAGE FIXING APPARATUS

[75] Inventors: Tetsuro Tomoe; Hiroaki Tsuchiya; Daisuke Hayashi; Shinichi Tanaka, all of Osaka, Japan

[73] Assignee: Mita Industrial Co., Ltd., Japan

[21] Appl. No.: 144,556

[22] Filed: Nov. 2, 1993

[30] Foreign Application Priority Data

Nov. 13, 1992 [JP] Japan ..... 4-303545

[51] Int. Cl.[6] ..... G03G 15/20

[52] U.S. Cl. ..... 355/282; 355/271; 355/309

[58] Field of Search ..... 355/282, 316, 355/285, 317, 286, 309, 290, 271; 49/216, 469, 470, 471

[56] References Cited

U.S. PATENT DOCUMENTS

| | | | |
|---|---|---|---|
| 4,369,729 | 1/1983 | Shigenobu et al. | 355/271 X |
| 5,223,901 | 6/1993 | Endo et al. | 355/285 |
| 5,285,245 | 2/1994 | Goto et al. | 355/271 |
| 5,287,156 | 2/1994 | Shikada et al. | 355/285 |
| 5,477,314 | 12/1995 | Tsuchiya et al. | 355/271 |

FOREIGN PATENT DOCUMENTS

| | | | |
|---|---|---|---|
| 58-122567 | 7/1983 | Japan | 355/282 |
| 60-63557 | 4/1985 | Japan | 355/317 |
| 3-061961 | 3/1991 | Japan | 355/282 |

*Primary Examiner*—Arthur T. Grimley
*Assistant Examiner*—Shuk Y. Lee
*Attorney, Agent, or Firm*—Beveridge, DeGrandi, Weilacher & Young

[57] ABSTRACT

Sheet transportation apparatus operating in an image forming system for xerographic printing employing magnetic toner. The inventive features of the sheet processing apparatus are directed toward smooth transportation and discharge of printing sheets sent through a system image printing unit, across a sheet transport guide, and through an image fixing and sheet transporting unit which finally discharges the printing sheets. The sheet transport guide dips downward and meets a sheet admission guide, having superficial resistivity lower than that of the sheet transport guide to reduce electrical repulsion of the leading edge of a transported sheet. The sheet admission guide guides each sheet into a nipping position of a heating/pressure roller pair as fixing rollers in the image fixing unit. The heating roller heater is designed to promote even heat emission axially along the cylindrical surface of the heating roller, counteracting unidirectional flow of cooling air in the system, ensuring smoothness in the image fixing, sheet-nipping transport of the printing sheet. Further, a gear train transmits power simultaneously to the fixing rollers, and to a discharge roller pair. A middle gear of the train is disengagable by a mechanism releasing the pressure roller from the heating roller, in turn releasing drive power engagement of the discharge rollers, so that a sheet-jam condition in the system is easily remedied.

65 Claims, 26 Drawing Sheets

SHEET TRANSPORTATION SYSTEM IN MAGNETIC-TONER XEROGRAPHIC IMAGE FIXING APPARATUS

CROSS-REFERENCE TO RELATED APPLICATION

This application is related to copending application Ser. No. 08/089,377, filed Jul. 12, 1993, commonly assigned with the present invention.

BACKGROUND

1 . Technical Field

The present invention relates to sheet processing apparatus included in an image forming system for xerographic printing; more specifically, the present invention relates to sheet transportation apparatus comprising a sheet transport guide provided between image printing and image fixing units of the image forming system, and further relates to a ensuring normal and smooth operation of the image fixing unit in its sheet transport function, and to a a mechanism associated with the sheet transportation apparatus for facilitating the remedying of sheet jams ocurring therein.

2. Description of the Background (1) An image forming system incorporated into such equipment as a copying machine or a facsimile terminal includes an image printing unit for transferring a toner-developed image onto a printing sheet, and an image fixing unit for fixing the toner image onto the sheet. Between the image printing unit and the image fixing unit, there is a sheet transport means for transporting the sheet bearing the unfixed toner image.

While the sheet bearing the unfixed toner image is transported to the image fixing unit, it is necessary to prevent the unfixed toner image from being damaged. Therein, Japanese Patent Publication No. 59581/1989 discloses that the surface resistivity of a guide member disposed on the sheet-discharging side of a transport belt be set between $1\times10^6\Omega$ and $1\times10^9\Omega$. In the above disclosure, since the guide member for guiding the transport of the sheet has a predetermined electric resistivity, electric charge carried by the sheet is not abruptly drained, whereby the unfixed toner image is not likely to be disturbed.

Accordingly, because the guide member guiding the sheet to be nipped by fixing rollers has a predetermined resistivity, is likely to carry a charge of the same polarity as that of the sheet. In this case, the leading edge of the sheet reaching the guide member could be repelled upward away from the guide member by electrostatic repulsion, whereby the leading edge of the sheet, being not properly guided to the nipping position of the fixing rollers, is caused to collide with the surface of the heating roller. This collision with the heat roller can disturb the unfixed toner image degrading image quality.

(2) In the image forming system, a sheet transportation apparatus is provided between the image printing unit, including a photoconductive drum, and an image fixing unit. A transport guide surface of the sheet transportation apparatus is bent so that the sheet conformingly bends as it passes along it and the sheet is smoothly guided to the nipping position of the fixing roller pair. This curve in the sheet absorbs the impact mentioned earlier, when the sheet collides with the heating roller. Damage to the image is thereby prevented.

Conversely, when the trailing edge of the curved sheet is released from a sheet-feeding resist roller pair, the curved sheet, flexes straight due to its stiffness, thereby pushing the paper backward through developing rollers of the image printing unit, which can damage the image in the image transferring region of the sheet. Japanese Patent Application Laid-Open No. 293272/1987, to prevent this reverse movement proposes to reduce the curve by setting the transport speed of the fixing roller pair higher than that of the resist roller pair.

When the difference of the transport speeds of the fixing roller pair compared to that of the feeding roller pair is too small, the sheet is not completely straightened and therefore the damage to the image is not sufficiently prevented. On the other hand, if the difference between both speeds is too large, the degree of magnification of the image differs before and after the leading edge of the sheet is nipped by the fixing roller pair and before and after the trailing edge of the sheet leaves the resist roller pair. Consequently, the image is distorted and can not be precisely reproduced.

(3) The image fixing unit in the image forming system includes a heating roller having a heater inside and a pressure roller pressed against the heating roller. As the sheet is transported between the rollers, the toner image on the sheet is fixed. Both ends of the heating roller of the fixing apparatus are rotatably supported by bearings. A power transmitting element such as a sprocket or a gear is fixed to the exterior side of one bearing. The power transmitting element is normally disposed on the rear side of the system for maintenance purposes or the like. An insulating member formed of a synthetic resin has been recently used for the power transmitting element in order to reduce the cost and weight.

A cooling fan is provided in the image forming system. Cooling air from the fan flows in a stream from the front side to the rear side of the system to prevent the heating roller from overheating various unit components. Since the stream of the cooling air runs along the heating roller, the surface temperature of the heating roller is high on the front side and low on the rear side.

Since the power transmitting element is disposed on the rear end of the heating roller (downstream of the cooling air) and in the rear of the system, and because the power transmitting element formed of a synthetic resin serves as an insulating member, heat from the heater is not likely to escape outside the system on the rear side. Consequently, heat emission becomes uneven, i.e., the temperature at the rear end of the heating roller is higher than that at the front end.

(4) In the image fixing unit of the image forming system, a thermistor for detecting the surface temperature of the heating roller is mounted in a housing covering the heating roller. Temperature data detected by the thermistor is input to a temperature controller for regulating the temperature output of a heater inside the heating roller. A temperature fuse is also provided in order to prevent the heating roller from becoming too hot due to a malfunction of the temperature controller. The temperature fuse is disposed close to the heating roller and melts when the heating roller is becomes abnormally hot, thereby interrupting supply of power to the heater in the heating roller.

Recently, it has been proposed that the housing covering the heating roller be formed of a heat-resistant resin (Japanese Patent Application Laid-Open Nos. 101780/1991, and 297578/1990). When the housing is formed of the heat-resistant resin, heat retaining properties and fixing performance during the image fixing operation are improved. Furthermore, the temperature of the system is prevented from becoming abnormally hot so that damage to the system is more likely to be minimal.

However, when the image fixing temperature runs hot out of control due to system malfunction or to a wiring error for example, the temperature could rise above the heat-resistant temperature of the resin which forms the housing. The housing will then thermally deform to an extent that mounting positions of the thermistor and temperature fuse could shift within the housing. If the thermistor separates from the heating roller due to thermal deformation of the housing, for example, the temperature it detects would be lower than the actual surface temperature of the heating roller, such that power would be further supplied to the heater, increasing the overall damage. Furthermore, if the temperature fuse also separates from the heating roller, the temperature fuse will not melt at the critical temperature. Consequently, the fixing apparatus would overheat, bringing about further damage to other components in the unit as a whole.

(5) A discharge roller unit for discharging sheets to the discharge tray is provided on the sheet-discharging side of the image fixing unit within the image forming system. The discharge roller unit includes a pair of upper and lower rollers. The sheet is nipped between both rollers and transported to the discharge tray which is disposed outside the system.

When a sheet gets jammed between the pair of rollers of the fixing apparatus or the discharge rollers, the jammed sheet can be readily taken out by releasing pressure between the rollers or by releasing the driving force on each roller. Conventional systems employ devices wherein the upper and lower frames are openable, the heating roller and the upper roller of the discharge rollers being mounted in the upper frame, and the pressure roller and the lower roller of the discharge rollers being mounted in the lower frame. In a sheet jam situation, the upper frame is opened so that the heating roller and the upper discharge roller are parted from the respective rollers beneath. Consequently, the sheet jammed in the discharge portion can be easily taken out.

As described above, upper and lower rollers in this conventional structure are likely to become offset from their original alignment, causing the sheet discharging function to be degraded. For this reason, other conventional system approach jammed sheet removal without displacing the rollers. A magnetic clutch or a one-way clutch is provided between the discharge roller pair and a roller-driving power train, for releasing the driving force on the roller pair. The magnetic clutch is turned off in a sheet jam situation in order to release the driving force on the discharge roller pair, at which point the jammed sheet can be readily taken out. Alternatively, the one-way clutch readily allows jammed sheets to be removed in a single direction.

However, the magnetic clutch and the one-way clutch are expensive, increasing the costs of the image forming system. In addition, since the jammed sheet is removable in only one direction when the one-way clutch is provided, it is difficult to remedy the jammed sheet in some apparatus.

SUMMARY OF THE INVENTION

It is an object of the present invention to prevent the leading edge of a printing sheet guided by a guide member from colliding with the surface of an image fixing roller, and at the same time further prevent damage to the unfixed toner image on a printing sheet.

It is another object of the present invention to prevent transport speed variations from influencing the degree of magnification of the unfixed toner image as much as possible, and further to prevent distortion of said image along the sheet transporting direction.

It is still another object of the present invention to reduce unevenness in surface temperature along the heating roller.

It is still another object of the present invention to maintain normal functioning of the thermistor and the temperature fuse by preventing their displacement away from the heating roller despite abnormal heating therein, due to malfunction in the associated temperature controller, or to like causes.

It is yet another object of the present invention to facilitate easy handling of jammed sheets between pressing sheet-transporting roller pairs by releasing the driving force on the roller pairs and by releasing pressure between them by means of an inexpensive structure.

(1) According to a first aspect of the present invention, an image forming system includes an image printing unit for printing onto a sheet surface an image developed with magnetic toner, an image fixing unit for fixing an unfixed toner image formed on the sheet surface by the image printing unit, a sheet transportation apparatus, and a sheet admission guide member. The sheet transportation apparatus has a predetermined superficial resistivity and includes a transport guide member for guiding a sheet from the image printing unit to the fixing unit. The admission guide member for guiding the sheet transported by the sheet transportation apparatus to the fixing unit has a surface resistivity lower than that of the transport guide member.

In this example, since the transport guide member has a predetermined superficial resistivity, electric charge on the sheet is not abruptly drained on the transport guide member so that the charged toner image will not be disturbed. In addition, since the superficial resistivity of the admission guide member is lower than that of the transport guide member, the admission guide member is not likely to be electrically charged. Therefore, electrostatic repulsion between the sheet and the admission guide member is less, such that the sheet is prevented from being repelled upward from the guide member and then colliding with any elements of the image fixing unit. Thus, damage to the toner image on the sheet surface due to colliding impact can be prevented.

(2) The present invention according to another aspect includes an image printing unit, an image fixing unit, and a transport guide member, wherein the image printing unit includes a sheet-feeding transport unit for transporting a sheet, and forming an image superficially onto the sheet during transport. The image fixing unit fixes the toner image superficially born by the sheet as it is transported. The transport guide member for guiding the transport of the sheet, forms a sheet transport path disposed between the image printing unit and the fixing unit and includes a bent guide surface such that the sheet in transport conforms to the bend in the path between the units. Sheet transport speed by the fixing unit is higher than that by the image printing unit, such that the sheet is completely straightened when the sheet leaves the transport unit of the image printing unit.

In this example, although the sheet in transport is curved downward along the guide surface of the transport guide member, the transport speed of the fixing unit being higher than that of the image printing unit causes the sheet on the transport guide member to be gradually straightened. By the time the trailing edge of the sheet is parted from the transport unit of the image printing unit, the sheet is completely straightened. Thus, damage to the image due to movement of the sheet can be prevented. Furthermore, since the dual transport speeds which would otherwise affect magnification of the unfixed toner image on the sheet in the sheet-transporting direction arise only after the trailing edge of the sheet is parted from the image printing unit, adverse influence on image magnification is kept to a minimum.

(3) According to still another aspect of the present invention, an image fixing unit provided for fixing an image superficially onto a sheet as it is transported includes a hollow heating roller, roller bearing means, circulating means and a heating means. Cooling air is streamed along the axis of the heating roller to protect the whole unit from heating effects. The roller bearing means rotatably supports the heating roller. The circulating means is disposed so as to press against the heating roller, therein for nipping and transporting a sheet together with the heating roller. The heating means is axially disposed in the heating roller, wherein the quantity of emitted heat upstream of the cooling air is greater than that downstream thereof.

In this example, heat emission from the heating unit upstream of the cooling air is greater than that downstream thereof. Since the cooling effect of the cooling air is greater upstream, the heating roller surface upstream is cooled more effectively. By incrementally increasing the quantity of heat emitted by the heating unit accordingly, the temperature difference along the heating roller surface from the front to the rear can be counteracted.

(4) According to still another aspect of the present invention, an image fixing apparatus in an image forming system for xerographic printing comprises an image fixing unit, a fixing unit housing, a temperature responsive element, and a position staying means. The image fixing unit for fixing an image superficially formed on a sheet includes a heating unit incorporating a heat source. The fixing unit housing covers the heating unit. The temperature responsive element is mounted in the fixing unit housing and responds to temperature change. The position staying means maintains a predetermined spacing between the temperature responsive element and the heating unit in case the fixing unit housing deforms due to thermal stress.

In this example, when the heating unit becomes overheated due to some malfunction and the temperature of the heating unit exceeds a heat-resistant temperature of the resin forming the fixing unit housing, the fixing unit housing deforms under the thermal stress. The position staying means, however, maintains the predetermined spacing between the temperature responsive element mounted on the fixing unit housing and the heating unit. Therefore, position of the temperature reacting member such as a thermistor is not far displaced even if thermal deformation of the fixing unit housing occurs, preventing the mis-regulation of temperature.

(5) According to still another aspect of the present invention, a sheet transportation apparatus includes a first sheet transport mechanism, a pressuring regulator mechanism, a second sheet transport mechanism, a power train, and a power train controller mechanism. The first sheet transport mechanism includes a first pair of reciprocally circulating sheet transport surfaces between which a sheet is transportable. The pressuring regulator mechanism pressuringly engages the first pair of sheet transport surfaces, and releases pressure between them. The second sheet transport mechanism is disposed close to the first sheet transport mechanism in the sheet-transporting direction and includes a second pair of reciprocally circulating sheet transport surfaces. The power train includes a drive gear mounted on the first sheet transport mechanism, a follower gear mounted on the second sheet transport mechanism, and a middle gear engageable with either of the other two gears and movable toward and away from at least one of the two gears. The power train controller mechanism engages the middle gear with both of the other gears when the pressuring regulator mechanism brings the first pair of sheet transport surfaces into a pressed together state; it also disengages the middle gear from at least one of the other two gears when the first pair of sheet transport surfaces is separated.

For jammed sheet removal, and other such occurrences, the first pair of sheet transport surfaces in the fixing unit, for example, are separated, then the middle gear is disengaged from one of the other two gears in conjunction with the pressure-releasing operation, such that drive power connection between the first and second sheet transport mechanisms is cut. Therefore, the second sheet transport mechanism is freed, so the jammed sheet can be readily removed. Thus, simply by providing a mechanism for moving the middle gear in conjunction with separation of the first pair of sheet transport surfaces in the first sheet transport mechanism, a sheet jammed in the second sheet transport mechanism can be easily removed.

These and other objects and advantages of the present invention will be more fully apparent from the following detailed description.

BRIEF DESCRIPTION OF THE DRAWINGS

FIG. 5(*b*) is a diagram graphing corresponding heat distribution characteristics of an axial heater within the heating roller;

DESCRIPTION OF THE PREFERRED EMBODIMENT

Overall Structure

Figure 1:
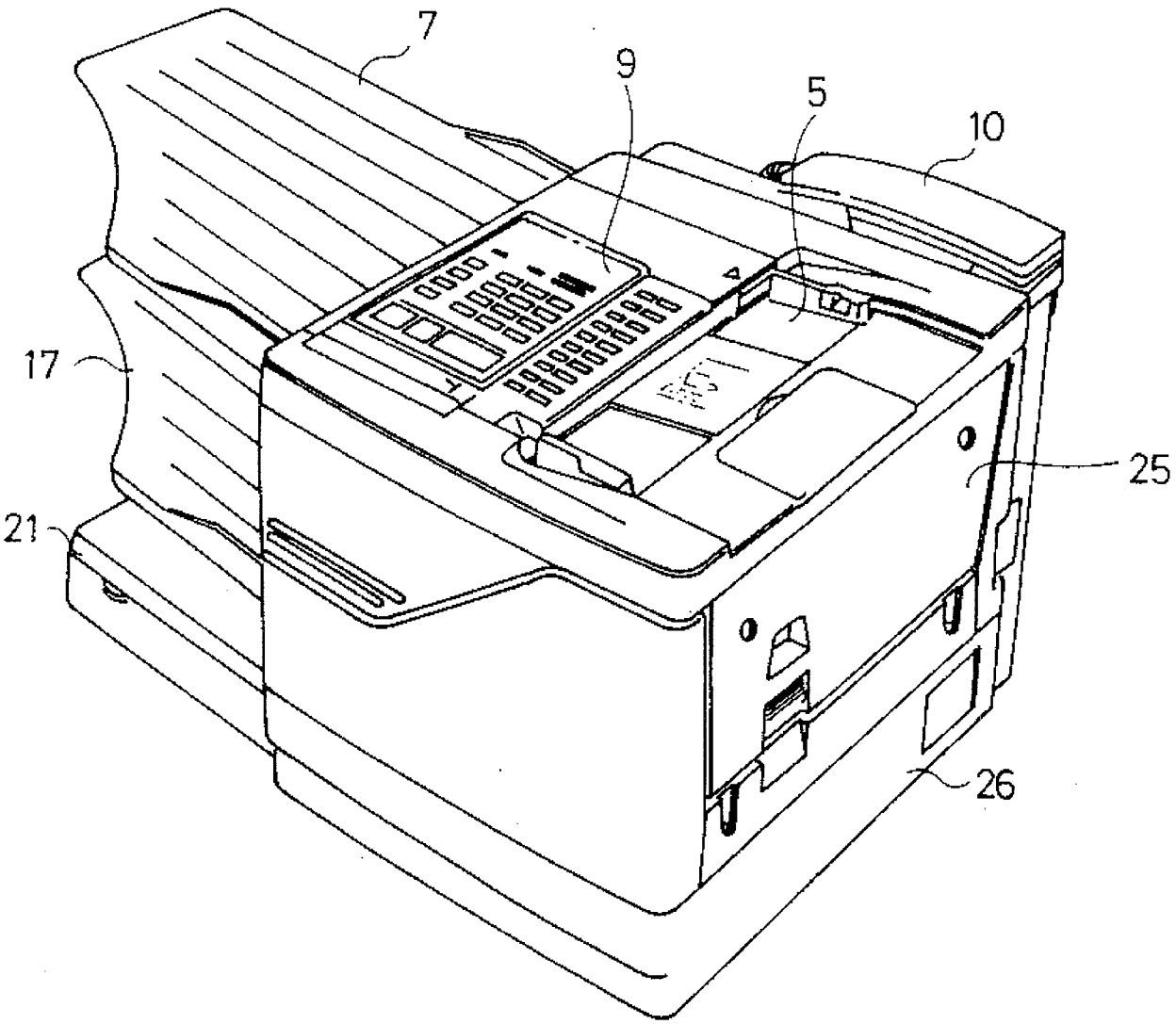
FIG. 1 is a schematic perspective view showing a facsimile terminal employing image forming equipment according to an embodiment of the present invention.
Figure 2:
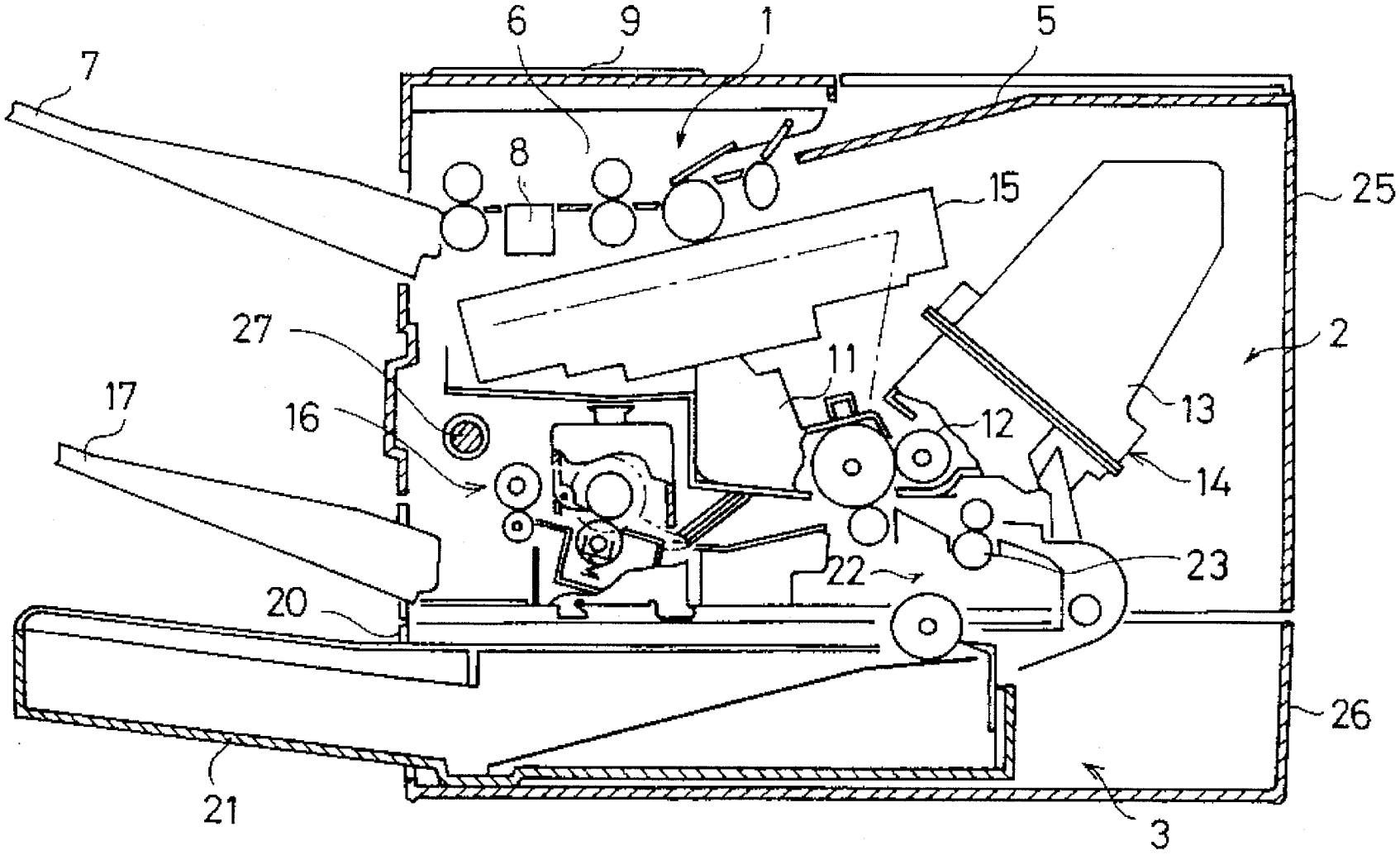
FIG. 2 is a schematic vertical section corresponding to FIG. 1.

Reference is made to FIG. 1, schematically illustrating in perspective view a facsimile terminal comprising image forming equipment in accordance with an embodiment of the present invention. Reference is additionally made to FIG. 2, a vertical section providing a schematic view through the facsimile terminal.

Therein, the image forming equipment is shown chiefly to comprise a reading part 1 for reading image information of an original document put into an upper portion of the equipment, xerographic printing and sheet processing apparatus 2 disposed in the center of the equipment, receiving the image information and printing it onto a sheet, and a sheet feeding part 3 disposed at the bottom of the equipment, for feeding copying sheets to the xerographic printing and sheet processing apparatus 2.

The reading part 1 includes an original retainer 5 on which the original is put, an original-transport section 6 for transporting the original, and an original-discharge tray 7 for storing originals discharged from the original-transport part 6. In the original-transport section 6, a sensor 8 for reading image information of the original is disposed. All operation panel 9 comprising various keys and a display is disposed on the upper surface of the terminal, and furthermore a handset 10 is disposed along an upper portion of the terminal. The xerographic printing and sheet processing apparatus 2 includes an imaging unit 11 comprising a photoconductive drum and associated elements; a developing unit 14 comprising a developing roller 12 and a toner cartridge 13, containing magnetic, single component toner; a laser unit 15 for forming on the surface of the photoconductive drum of the imaging unit 11 a latent image according to the information received; and an image fixing and sheet transport unit 16 for fixing an image printed from developing toner onto the sheet surface by the imaging unit 11. On the left of the image fixing and sheet transporting unit 16 in the figure, a sheet discharge tray 17 is provided. The feeding part 3 includes a feed cassette 21 which is detachably mounted in an opening 20 provided in the bottom portion of the terminal body, and a sheet-feeding unit 22 for feeding sheets from the feeding cassette 21 and supplying them to the xerographic printing and sheet processing apparatus 2. The sheet-feeding unit 22 includes a pair of resist rollers 23 for controlling sheet-supply timing.

The equipment body consists of an upper case 25 and a lower case 26. The upper case 25 is openable on a hinge 27. The upper case 25 contains the reading part 1 and the imaging unit 11, as well as the developing unit 14 and the laser unit 15 of the xerographic printing and sheet processing apparatus 2. The lower case 26 holds the image fixing and sheet transporting unit 16 of the xerographic printing and sheet processing apparatus 2, and the feeding part 3.

Imaging Unit and Transport Unit

Figure 3:
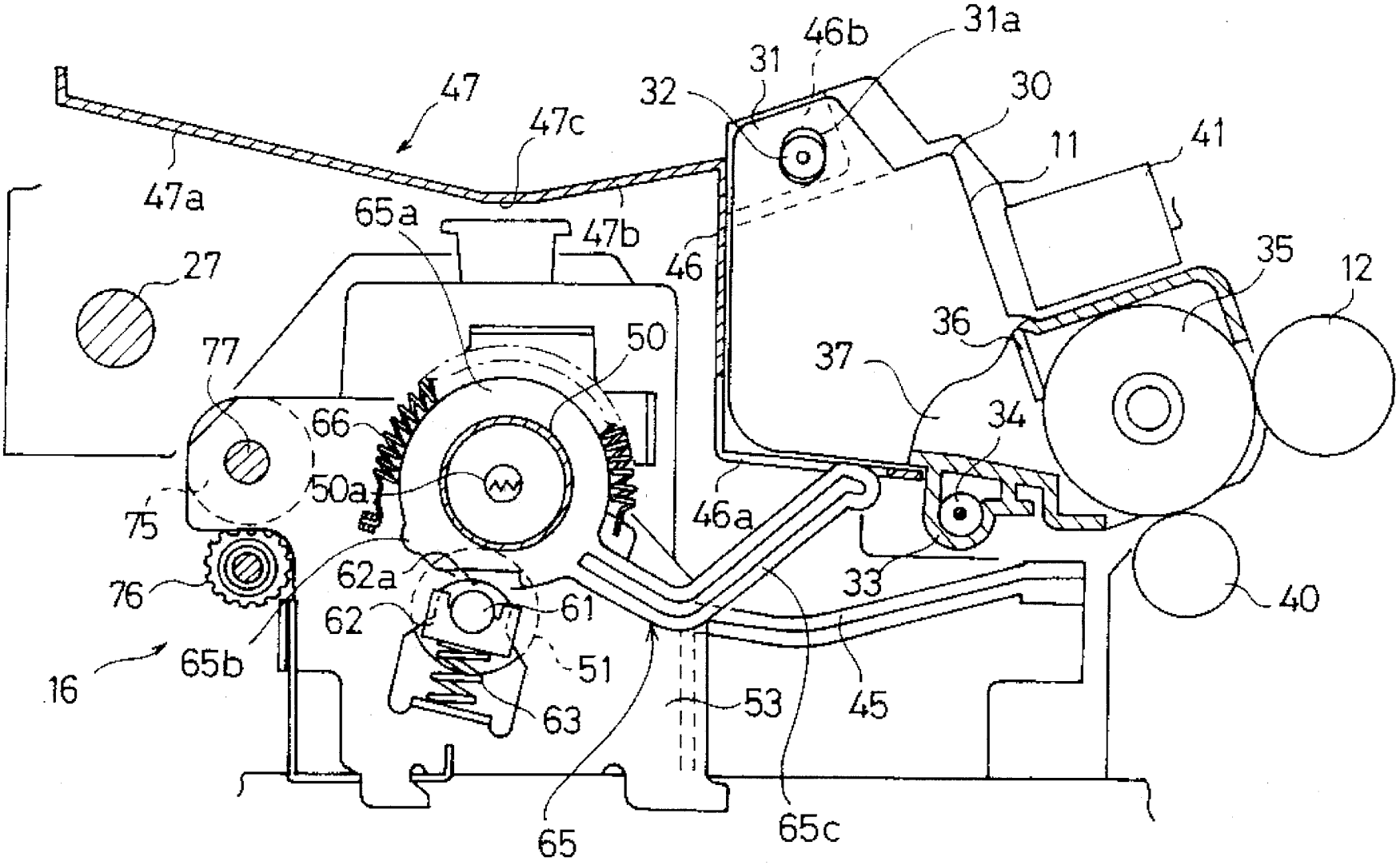
FIG. 3 is a detailed partial enlargement corresponding to FIG. 2, illustrating an image forming apparatus, and an image fixing and sheet transporting unit of the equipment.

Referring now to FIG. 3, the imaging unit 11 and the image fixing and sheet transport unit 16 of the xerographic printing and sheet processing apparatus 2 are depicted in detail in an enlarged partial view.

The imaging unit 11 is housed within a housing 30. Upwardly protruding mounting flanges 31 are formed at the upper ends of sides of the housing 30. A vertically extending slot **31*a* is formed in each mounting flange 31 and the slot 31*a* holds a pin 32 provided in a body frame of the facsimile terminal. Thus, the imaging unit 11 is vertically movable within a predetermined range. Furthermore, downward projecting retainers 33 are formed at lower portions of the housing 30. The retainers 33 receive pins 34 likewise provided in the body frame, positioning the imaging unit 30 in the vertical direction. A photoconductive drum 35 is rotatably mounted in the end of the imaging unit 11 adjacent the developing unit 14. A cleaning blade 36 for removing toner residual on the surface of the photoconductive drum 35 is provided alongside it. The residual toner removed from the surface of the photoconductive drum 35 by the cleaning blade 36 is collected into a residual toner container 37 defined by the housing 30**.

A transfer roller 40, printing the toner-developed image on the photoconductive drum 35 by transferring it onto the sheet, is disposed under the photoconductive drum 35. The transfer roller 40 is rotatably supported by the frame of the lower case 26. A main charger 41 for charging the surface of the photoconductive drum 35 is disposed above it.

Thus, an image printing apparatus for printing a toner-developed image onto the surface of a sheet consists of the imaging unit 11, the developing unit 14, the transfer roller 40 and the main charger 41. In this embodiment of the present invention, since the photoconductive drum 35 is negatively charged and the toner carries positive electric charge, the sheet is accordingly charged by the transfer roller 40 to have negative polarity.

A sheet transport guide 45 for guiding the sheet bearing the printed toner image toward the image fixing and sheet transporting unit 16 is disposed downstream from the image printing apparatus in a sheet-discharging direction of the image forming equipment. The sheet transport guide 45 is connected to a lower sheet-admission guide 49, indicated in FIG. 4, fixed to a base 48 of the image fixing and sheet transport unit 16, wherein the transport path formed by the guides 45 and 49 together dips downward. The sheet transport guide 45 is made of a resin for controlling conductivity. A resin having a superficial resistivity of $10^{12}\Omega$ is used in the present embodiment. The lower sheet-admission guide 49 is manufactured of a galvanized steel having a superficial resistivity of approximately $1^{2}\Omega$, not to exceed $10^{7}\Omega$. Above the sheet transport guide 45, a middle frame 46 is disposed immediate the imaging unit 11. The middle frame 46 is formed of, for example, an iron plate, such that it is an electrical conductor. The middle frame 46 is in contact with the imaging unit 11 through flanges **46*b* and is grounded through another frame. Two cutouts 46*a*** are formed in the middle frame corresponding to opposite sides widthwise of the printing sheet.

Image Fixing and Sheet Transport Unit

Figure 4:
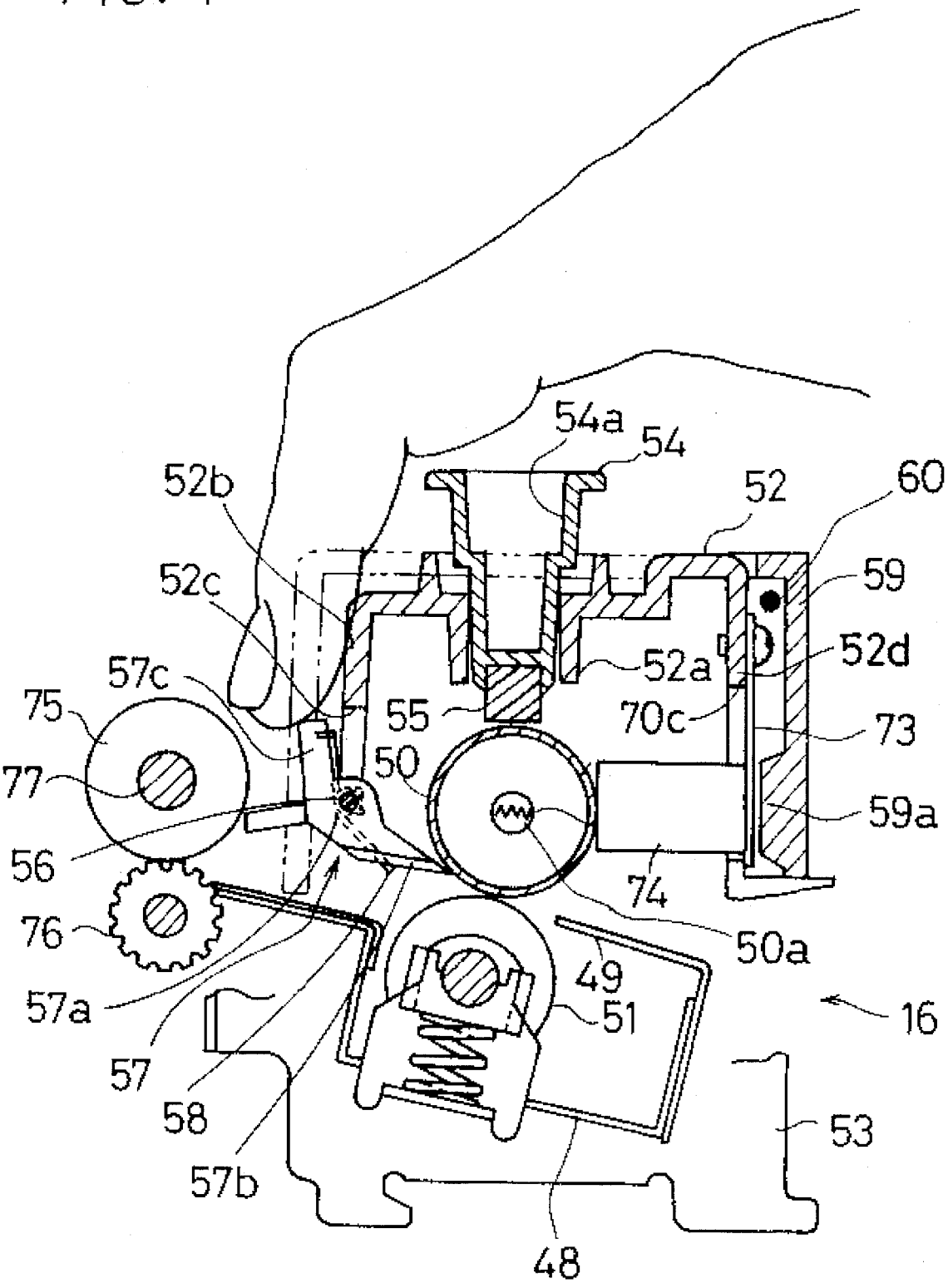
FIG. 4 is a partial view in vertical section of the unit.

Referring to FIGS. 3 and 4, the image fixing and sheet transporting unit 16 includes a heating roller 50, inside which is a heater **50*a*, against which a sheet transport pressure roller 51 is pressible. The surface of the heating roller 50 is coated with an electrically conductive PTFE (polytetra/fluoroethylene) resin having a surface resistivity of $10^{6}\Omega$. A fixing unit upper housing 52 surroundingly covers the heating roller 50. The upper housing 52 is formed of a heat-resistant resin such as PBT (polybutylene terephthalate), having heat resistance of approximately 200° C. The upper housing 52 extends axially along the heating roller 50 and is detachably mounted in a fixing unit lower housing (not shown). The lower housing is fixed to frames 53 of a pair which is provided flanking the axial ends of the rollers 50 and 51. A channel 52*a* through which a mounting member 54 is detachably inserted is formed in the central portion of the upper wall of the upper housing 52 along the axial direction of the rollers. The mounting member 54 has a central cavity 54*a*. A cleaning element 55 for cleaning the surface of the heating roller 50 is mounted in the bottom of the mounting member 54**.

Two cutouts **52*c* are formed in lateral wall 52*b* of the upper housing 52 on the sheet-discharging side along the axial direction of the rollers. A support pin 56 is located in each cutout 52*c*. A separating claw 57 for separating a sheet in transport from the heating roller 50 is rotatably supported on each support pin 56. Each separating claw 57 comprises a support portion 57*a* supported on the corresponding support pin 56. A separator portion 57*b* extending from the support portion 57*a* toward the heating roller 50 and a lever portion 57*c* extending from the support portion 57*a* to the exterior side of the lateral wall 52*b*. The separator portion 57*b* is pressed against the surface of the heating roller 50 by a torsion spring 58. The lever portion 57*c* protrudes from the cutout 52*c* and is thus exposed to the exterior side of the lateral wall 52*b*. When the upper housing 52 is mounted or dismounted, an operator pushes a lever portion 57*c* toward the side wall 52*b* as shown in FIG. 4, in order that the ends of the separator portions 57*b* be lifted off the surface of the heating roller 50**.

By means of the separating claw 57, a sheet which in undergoing image fixing tends to wind around the surface of the heating roller 50 is readily detached therefrom. Furthermore, when the upper housing 52 is mounted or dismounted, for example for parts replacement, the end of the separating claw 57 is securely separable from the surface of the heating roller 50 by holding the lever portion **57*c*, whereby potential damage therein to the heating roller surface 50** is prevented.

Figure 5A:
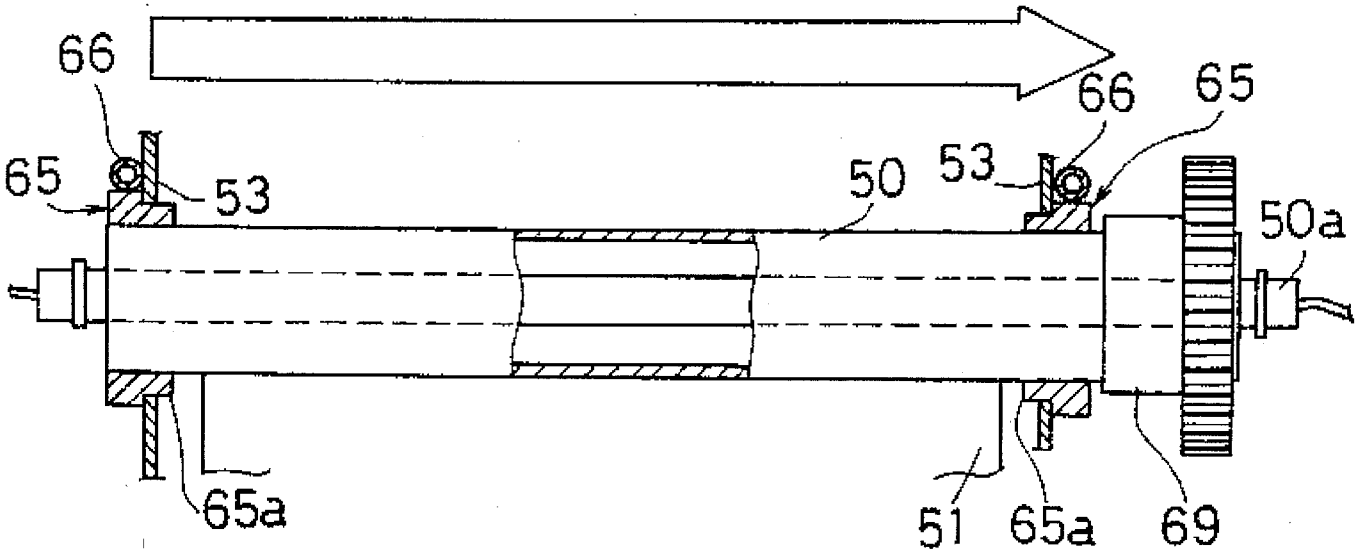
FIG. 5(*a*) is a partially cut away lateral view of a heating roller of the image fixing and sheet transport unit.
Figure 5B:
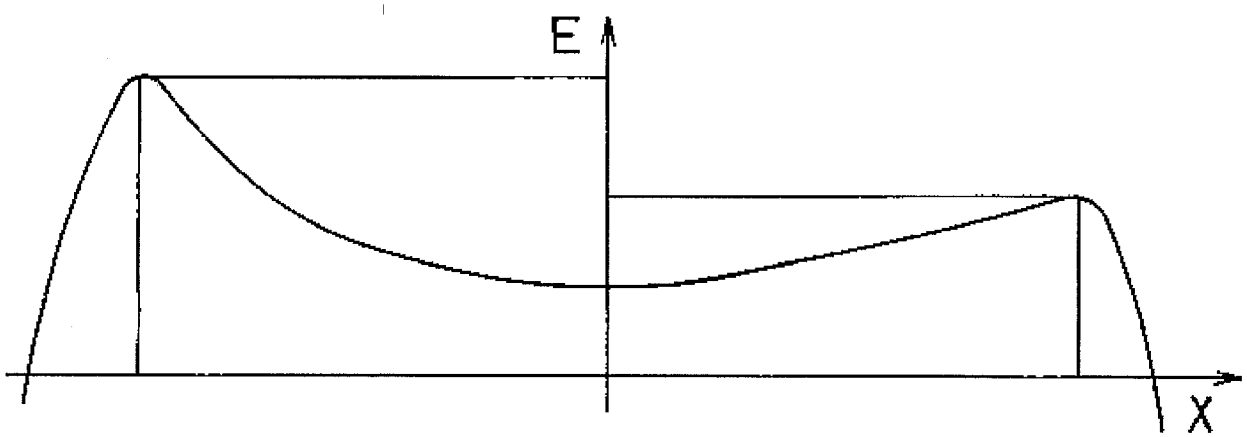

Referring to FIGS. 3 and 5(*a*), pressure-releasing levers 65, formed of a resin such as PPS (polyphenylene sulfite), are disposed on either end axially of the heating roller 50. The heating roller 50 is rotatably supported in the frame 53 by retaining rings **65*a* of each pressure-releasing lever 65. A pinion gear 69 for driving the heating roller 50 is mounted on the rear end (to the right in FIG. 5**(*a*)) of the heating roller 50. The pinion gear 69 is formed of a synthetic resin having heat insulating properties, such as polyamide-imide resin.

A heater **50*a* comprising a resistance winding is disposed inside the heating roller 50 along its axis. Heat distribution characteristics of the heater 50*a* are such that the quantity of heat emitted is controllable according to winding density. Specifically, heat emission is made to be greatest toward the front, lowest in the middle, and greater toward the rear than in the middle but less than toward the front, as can be seen representatively from the FIG. 5**(*b*) graph, in which the direction X is rearward along the axis of the winding, and, E indicates emitted heat energy.

The heater **50*a* is designed to have the heat distribution as described above for the reason that with two heat insulating members such as the bearing 65*a* and the pinion gear 69, mounted surrounding the heater 50*a* toward the rear, heat is not as likely to be diffused in the rear of the unit as it is in the front. Therefore, if a heater having uniform heat distribution characteristics were to be used, the heating roller 50 surface temperature toward the rear would be higher than toward the front. Furthermore, this kind of equipment is cooled using a fan; however, air from the fan usually streams from the front to the rear, as indicated by the arrow, so as to prevent warm air from being blown out toward the operator. Consequently, since the temperature of the cooling air is lower toward the front, the cooling effect is greater in the front than in the rear. Thus, if the heat distribution of the heater were uniform, the heating roller 50 surface temperature in the rear would be higher than in the front. Taking the foregoing into due consideration, the quantity of emitted heat is made to be greater in the front than in the rear. Unevenness in surface temperature of the heating roller 50** is accordingly avoidable to a certain extent.

Additionally, an axle 61 carrying the pressure roller 51 is supported at either end on the frame 53 through a bearing 62 and a spring 63. A knob **62*a* projecting upward is provided on the upper portion of each bearing 62. The bearing 62 is vertically shiftable and is constantly impelled against the heating roller 50 by the elasticity of the spring 63. The bearings 62 and springs 63 are thus located on opposite ends of the pressure roller 51, adjacent each pressure releasing lever 65**.

Each of the pair of pressure releasing levers 65 is rotatably mounted, concentric with the heating roller 50, and includes a retaining ring **65*a* supporting the heating roller 50, a cam 65*b* formed in a portion of the retaining ring 65*a*, from which an L-shaped lever arm 65***c* extends toward the imaging unit 11. One end of the pressure releasing lever 65 is impelled counterclockwise in FIG. 3 by a spring 66 retained by the frame 53. When the imaging unit 11 is mounted into the imaging forming equipment, the ends of the lever arms 65*c* pass through the cutouts 46*a* of the middle frame 46 and abut on the bottom surface of the housing 30. Thus, each lever arm 65*c* is rotated clockwise against the impelling force of the spring 66. In this state, the cam 65*b* is turned away from the knob 62*a* of the bearing 62 supporting the pressure roller 51. Therefore, the pressure roller 51 is elastically pressed against the heating roller 50 by the spring 63.

Figure 6:
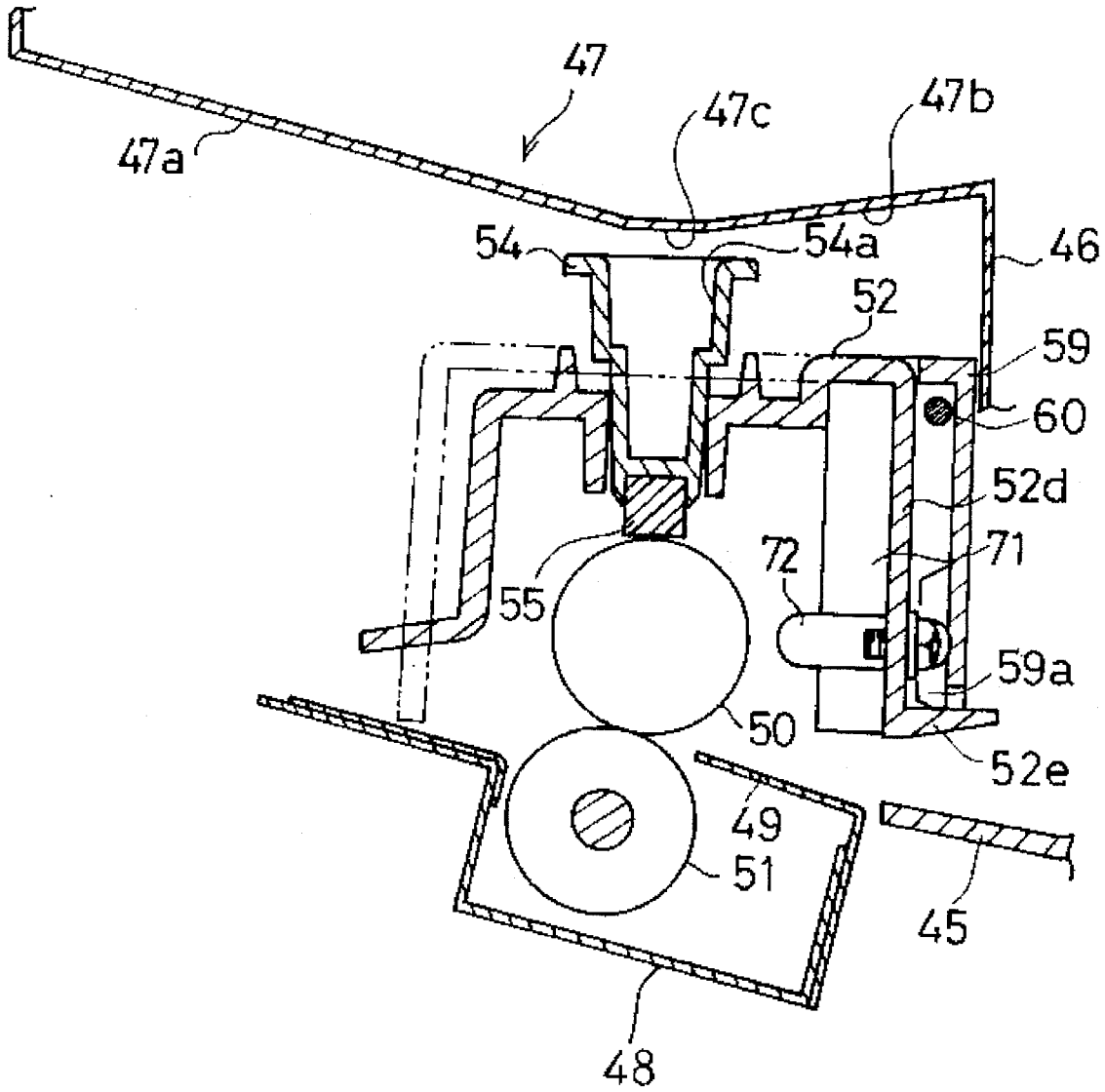
FIG. 6 is a view corresponding to FIG. 4, illustrating an installed temperature fuse of the unit.
Figure 7:
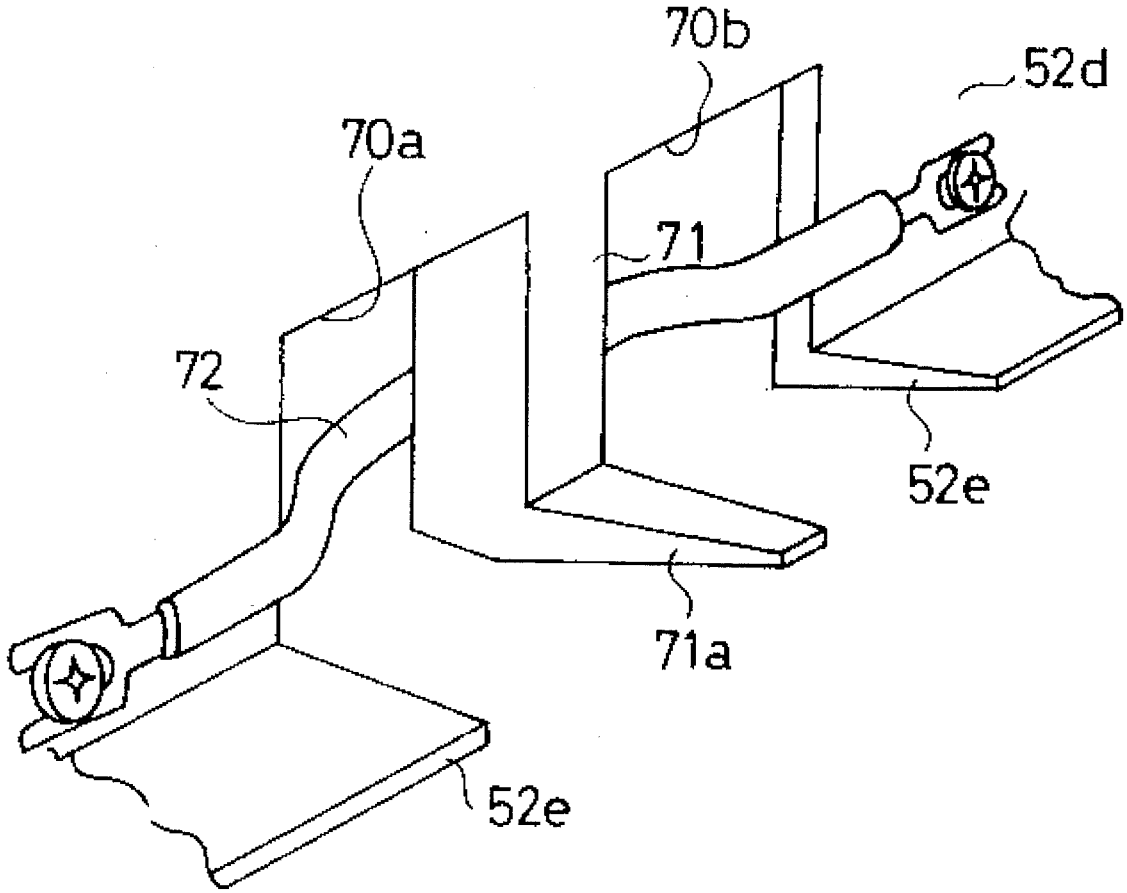
FIG. 7 is a perspective view showing a temperature fuse mounting portion in a housing of the unit.

Referring to FIGS. 6 and 7, two cutouts 70*a* and 70*b* are formed in the lateral wall 52*b* of the upper housing 52 on the side toward the image printing apparatus and a fuse catch 71 is formed between the cutouts 70*a* and 70*b*. A temperature fuse 72 is laced through along the interior side of the housing 52 and both ends of the temperature fuse 72 are fixed to the exterior surface of the housing lateral wall 52*d* by screws. Although not shown, the heater 50*a* inside the heating roller 50 is electrically wired to the fuse 72 ends fixed by the screws. Thus, as the temperature fuse 72 is installed Immediate the heating roller 50, the distance between them is easily and precisely adjustable.

Upper sheet-admission guides 52*e* and 71*a* are formed at the lower ends of the lateral wall 52*d* and the fuse catch 71, respectively, whereby a supplied printing sheet is guided as it is introduced between the heating roller 50 and the pressure roller 51.

With reference to FIG. 4 and subsequently to FIG. 6, a cutout 70*c* is formed in a portion of the lateral wall 52*d* of the upper housing 52 on the sheet-introducing side. A mounting element 73 is fixed by screws to the lateral wall 52*d* having the cutout 70*c*. A thermistor 74 is fixed to the lower end of the mounting element 73. The thermistor 74 is employed as a measuring a device for detecting the surface temperature of the heating roller 50, and providing temperature data input to a temperature adjustment circuit (not shown), whereby electric power supplied to the heater 50*a* inside the heating roller 50 is controlled such that the surface temperature of the heating roller 50 is 185° C.

A fixing unit cover 59 is mounted on the right side in the figure of lateral wall 52*d* of the upper housing 52. The cover 59 is formed of a resin such as PET (polyethylene terephthalate) having a heat resistance higher than that of the upper housing 52. The cover 59 covers the screws fixing the mounting element 73 and the screws fixing the temperature fuse 72, as well as a wiring 60 connected to both the temperature fuse 72 and the thermistor 74. The cover 59 is mounted between the front and rear frames 53 parallel with the lateral wall 52*d* at a predetermined spacing. The upper and lower portions of the cover 59 are seated in corresponding notches provided in the upper housing 52. Along the lower inner portion of the cover 59, a plurality of vertical ribs 59*a* are provided within a predetermined range opposite the thermistor 74, ulterior to the heating roller 50.

In this structural arrangement, if for some reason the heating roller 50 becomes abnormally heated such that its temperature exceeds the heat resistance of the upper housing 52, the lateral wall 52*d* deforms, expanding outwardly. The mounting element 73 and the thermistor 74 are thereby moved in the direction away from the heating roller 50. Thus, in an instance in which the heating roller 50 overhears, with the thermistor 74 moved apart from the heating roller 50, the thermistor 74 derives temperature data which is nevertheless lower than the actual surface temperature of the heating roller 50. In this embodiment of the present invention, however, since the ribs 59*a* on the cover 59 are arranged behind the thermistor 74, even if the lateral wall 52*d* is deformed, the ribs 59*a* prevent the thermistor 74 from warping outwardly. Consequently, the thermistor 74 is maintained in its initial position.

Moreover, the spacing between the lateral wall 52*d* and the cover 59 serves as a heat-insulating layer of air such that if the upper housing 52 is deformed by heat, the cover 59 will not deform together with the lateral wall 52*d*. Furthermore, since the cover 59 is formed of a resin having heat resistance higher than that of the upper housing 52, the cover 59 is not likely to become as deformed by heat as the lateral wall 52*d*.

Still further, the ribs 59*a* of the cover 59 also prevent deformation of the fuse catch 71 retaining the temperature fuse 72, such that the temperature fuse 72 is prevented from departing its position near the surface of the heating roller 50. Consequently, the temperature fuse 72 will melt at its rated temperature so as to cut off the supply of electric power.

Referring to FIGS. 3 and 6, the middle frame 46 extends out over the image fixing and sheet transporting unit 16 and serves as a partition 47 between the image fixing and sheet transporting unit 16 and the image forming equipment upper portion. The partition 47 includes dihedral surfaces 47*a* and 47*b* meeting in a lowest collecting surface 47*c* above the mounting member 54, wherein water drops forming along the dihedral surfaces 47*a* and 47*b* collect.

Figure 8:
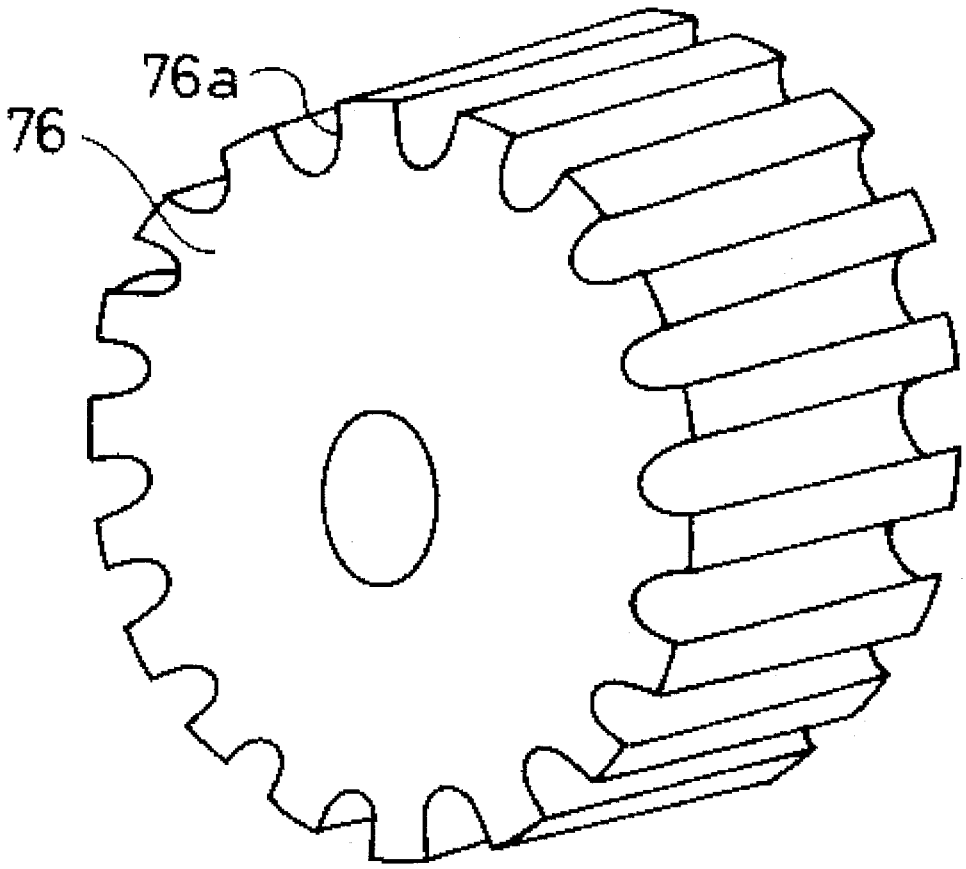
FIG. 8 is a perspective view showing the lower roller of a sheet-discharge roller pair in the image fixing and sheet transport unit.
Figure 9:
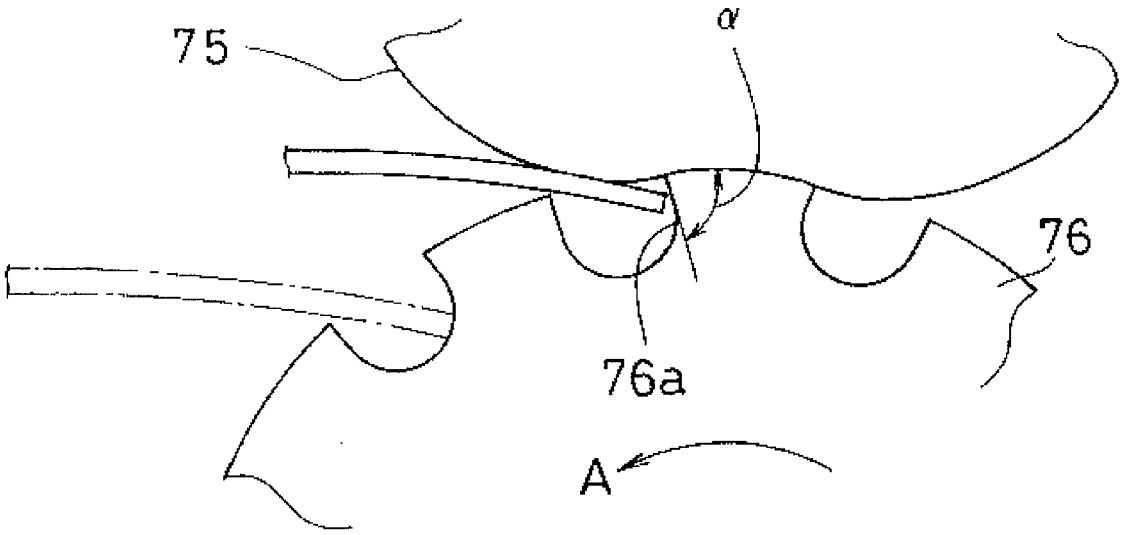
FIG. 9 is an enlarged partial view showing the lower roller.

As shown in FIGS. 3 and 4, a pair of sheet discharge rollers 75 and 76 is disposed downstream from the image fixing and sheet transporting unit 16. The upper roller 75 is formed of an elastic material such as rubber or plastic foam, and is fixed to a drive shaft 77 supported on the frame 53. The lower roller 76 is rotatably supported in the lower housing (not shown). The lower roller 76 is formed of a resin such as POM (polyacetal), such that it is harder than the upper roller 75, and it has a plurality of axially-cut peripheral grooves 76*a* fluted to be U-shaped sectionally, as shown in FIGS. 8 and 9. The lower roller 76 is substantially cylindrical, being, for example, 12 mm in outside diameter, 4.3 mm inside diameter and 8 mm in thickness; and each groove 76*a* is 1.2 mm in width, there being fifteen circumferentially equidistant grooves. As enlargedly shown in FIG. 9, each groove is cut such that an angle $\alpha$, between the side of the groove and a line tangent to the cylindrical surface of the lower roller 76, is determined to be 90° or less.

In this structure, as the lower roller 76 is rotated in the direction indicated by arrow A in FIG. 9 to discharge the sheet, it elastically depresses the upper roller 75 such that an adjacent portion of the upper roller 75 bulges toward a groove 76*a*, pushing the sheet into the groove 76*a*. Thus, the trailing edge of the sheet will drop further into the groove, such that the sheet is surely discharged toward the discharge tray.

Figure 10:
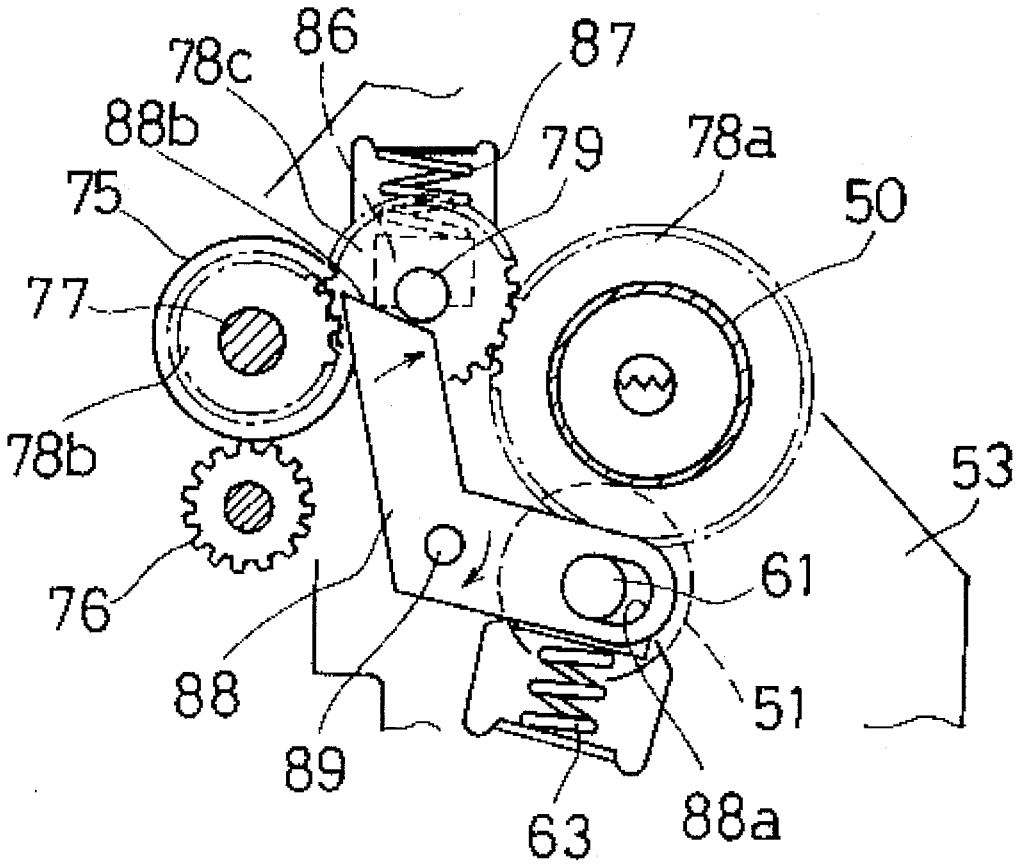
FIG. 10 is a rear partial view showing details of a mechanism for releasing the impelling force on the pair of sheet discharge rollers.

As shown in FIG. 10, a mechanism for releasing the impelling force on the discharge rollers 75 and 76 is provided at the rear of the image forming equipment on the further rear side of the frame 53. This mechanism will be described.

A drive gear 78*a* is fixed to the rearward end of the heating roller 50. A follower gear 78*b* is fixed to a corresponding end of the drive shaft 77 to which the upper roller 75 of the pair of sheet discharge rollers is fixed. The drive gear 78*a* and the follower gear 78*b* are connected by a middle gear 78*c*. The middle gear 78*c* is mounted on a mid-shaft 79. The mid-shaft 79 is rotatably supported by a bearing 86 which is vertically shiftable. The bearing 86 is constantly impelled downward by a spring 87.

The axle 61 carrying the pressure roller 51 is held in a slot 88*a* formed in one end of a release arm 88. The release arm 88 is rotatably mounted on a pin 89 in the frame 53. The other end of the release arm 88 is formed as an oblique surface 88*b* on which the mid-shaft 79 abuts.

The release mechanism is structured such that when the release arm 88 is rotated clockwise in FIG. 10, the mid-shaft 79 is pushed upward by the oblique surface 88*b*, thereby disengaging the middle gear 78*c* from the follower gear 78*b*.

Sheet Transporting System

Next, sheet transportation will be described following the FIG. 11 schematic view of the sheet transport system.

In this illustration, the sheet transport system is shown to include resist rollers 23, the transport guide 45, the lower sheet admission guide 49, the image-fixing roller pair 50 and 51, and the discharge roller pair 75 and 76 arranged along the sheet transporting direction. The photoconductive drum 35 is not in contact with the transfer roller 40. Since the guide surface of the transport guide 45 is inclined downward, the sheet transported from the photoconductive drum 35 is curved by the surface of the transport guide 45 and guided along the lower admission guide 49 toward the heating roller 50 and the pressure roller 51. The speed at which the roller pair 50 and 51 transport the sheet is set higher than that at which the resist rollers 23 do, so as to straighten the sheet after its leading edge is inserted between the heating roller 50 and the pressure roller 51. The sheet transport speed of the resist rollers 23, and of the roller pair 50 and 51 will be described in detail.

Figure 11:
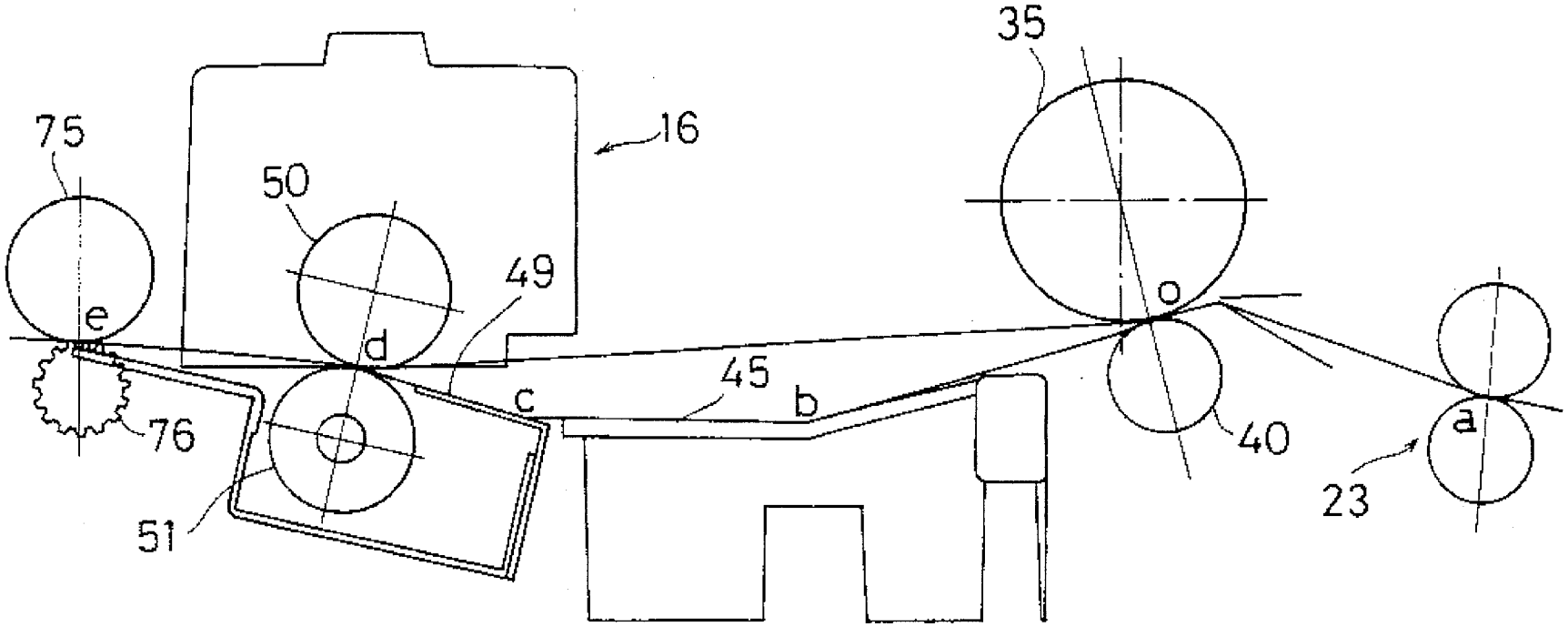
FIG. 11 is a schematic elevational diagram illustrating a sheet transport system and path.

Each of the reference letters indicated in FIG. 11 is defined as follows:

- o: intersection of a line tangent to the cylindrical surface of the photoconductive drum 35 and a line through the centers of the photoconductive drum 35 and the transfer roller
- a: line of contact between the upper and lower resist rollers 23;
- b: line of dihedral intersection on the transport guide 45;
- c: line of contact with the lower admission guide 49;
- d: line of contact between the heating roller 56 and the pressure roller 51. Furthermore, the following terms are defined:
- $\lambda_a$(mm): distance between o and a;
- $\lambda'$ (mm): (distance between o and b)+(distance between b and c)+(distance between c and d);
- $\lambda$ (mm): distance between o and d;
- L (mm): full length of a sheet; and
- $V_d$(mm/s): circumferential speed of the photoconductive drum.

From the above conditions, it follows that the curved length of the sheet is ($\lambda'-\lambda$) (mm); then, sheet transport speeds are each set such that the sheet is straightened during the period of time from when the leading edge of the sheet enters between the roller pair 50 and 51, until the trailing edge of the sheet comes off the resist rollers 23. The circumferential speed $V_f$ of the fixing roller pair 50 and 51 is accordingly found as follows.

The time required for the trailing edge of the sheet to leave the resist rollers 23 after the leading edge of the sheet has entered between the roller pair 50 and 51 is:

$$(L-\lambda'-\lambda_a)/V_d$$

Consequently, the circumferential speed $V_f$ (mm/s) of the fixing roller pair required in order to straighten the curved length of the sheet ($\lambda'-\lambda$) is:

$$v_f - v_d = \frac{\lambda' - \lambda}{(L-\lambda'-\lambda_a)/v_d}$$

Therefore, $$v_f = v_d + \frac{(\lambda'-\lambda)v_d}{L-\lambda'-\lambda_a} = \frac{L-\lambda-\lambda_a}{L-\lambda'-\lambda_a}\, v_d \text{ (mm/s)}$$

It is thus found that the circumferential speed of the fixing roller pair 50 and 51 is preferably within a range such that it is $(L-\lambda-\lambda_a)/(L-\lambda'-\lambda_a)$ or greater times that of the resist rollers 23, yet such that it does not influence the degree of magnification of the image.

A specific example of the sheet transport system is detailed below. Given that the following conditions are assumed, namely, that:

- overall length L of a sheet=297 mm;
- distance between the photoconductive drum and the resist rollers $\lambda_a$=45 mm;
- distance in a straight line between the photoconductive drum and the fixing roller pair $\lambda$=99 mm; and
- distance between the photoconductive drum and the fixing roller pair including the curved length of the sheet $\lambda'$=100 mm;
- then the circumferential speed $V_f$ of the fixing roller pair is found as follows.

$$V_f=[(297-99-45)/(297-100-45)]V_d=(153/152)\cdot V_d=1.0066V_d$$

Accordingly, the circumferential speed of the fixing roller pair is defined to be 1.0066 times that of the resist rollers.

Therein, the circumferential speed of the resist rollers and that of the fixing roller pair are made to be almost equal by setting the diameter of the resist rollers 23 and adjusting the reduction gear ratio of the gear train constituting a power transmission system between the fixing roller pair 50 and 51. Then, when the heating roller 50 is manufactured, its outside diameter is adjusted such that the transporting speed of the fixing rollers is 1.0066 times that of the resist rollers.

Mounting Structure of Image Fixing and Sheet Transport Unit

Figure 12:
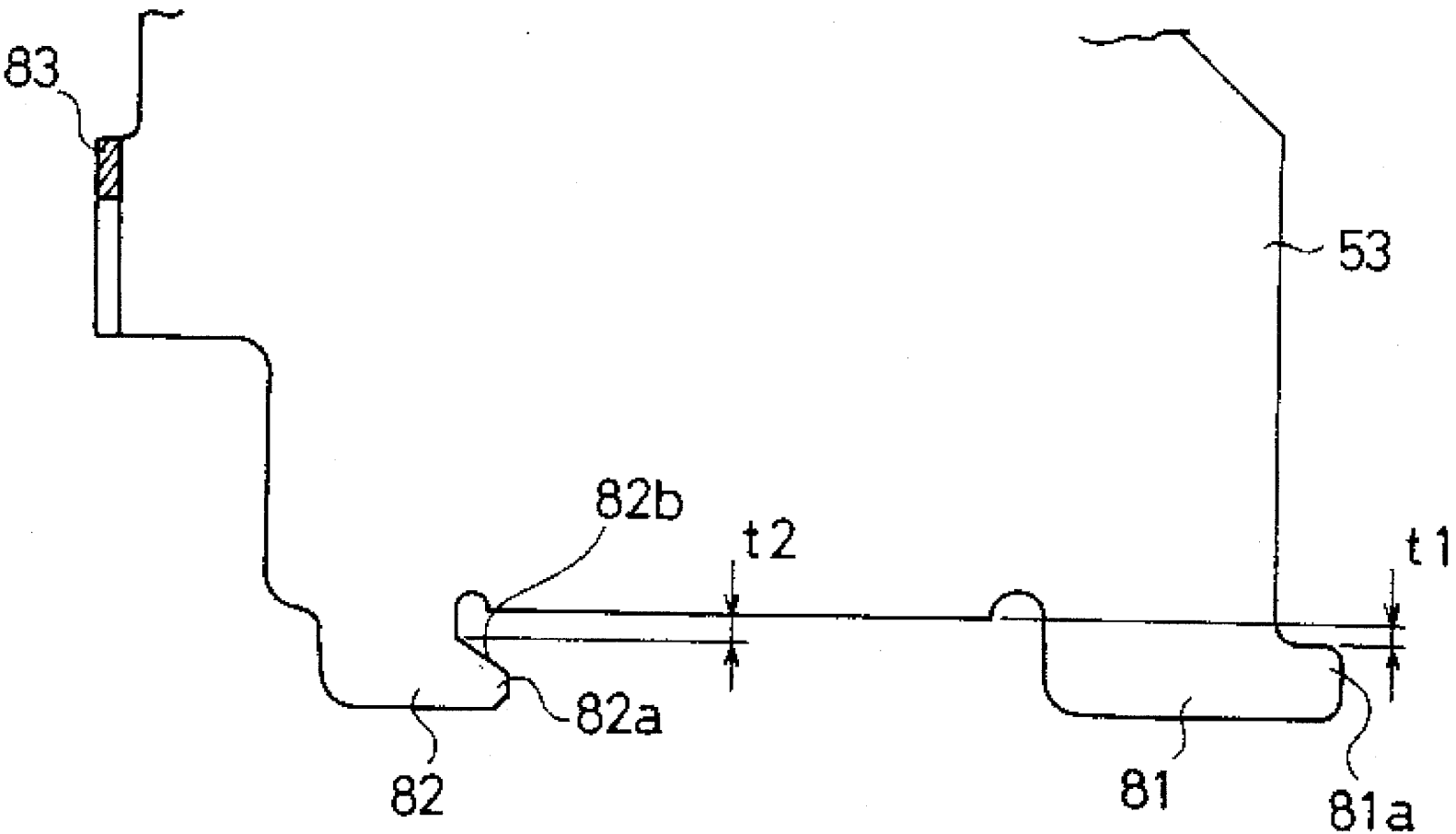
FIG. 12 is a partial elevational view of a frame of the unit.
Figure 13:
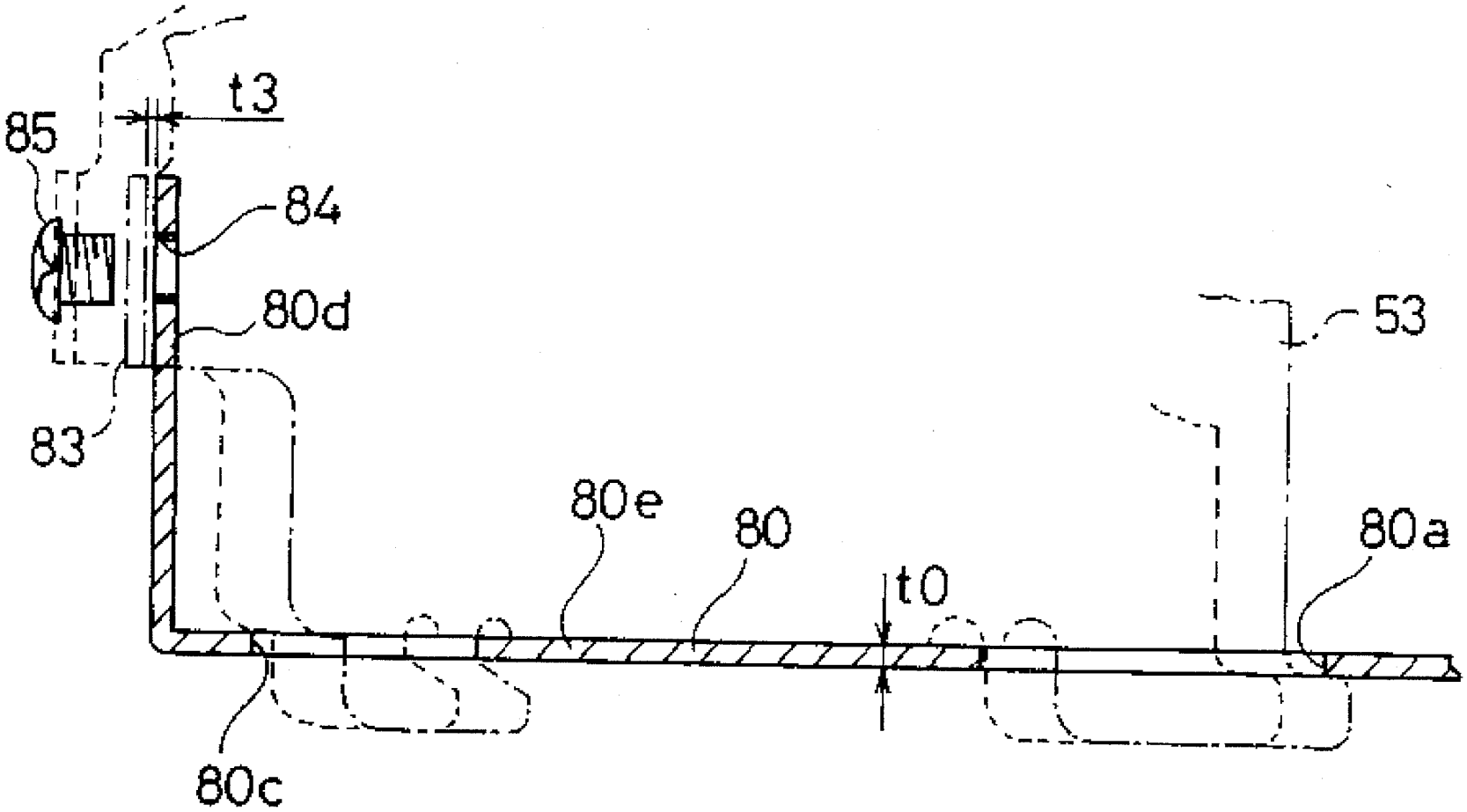
FIG. 13 is a sectional view through a mounting frame of the unit.
Figure 14:
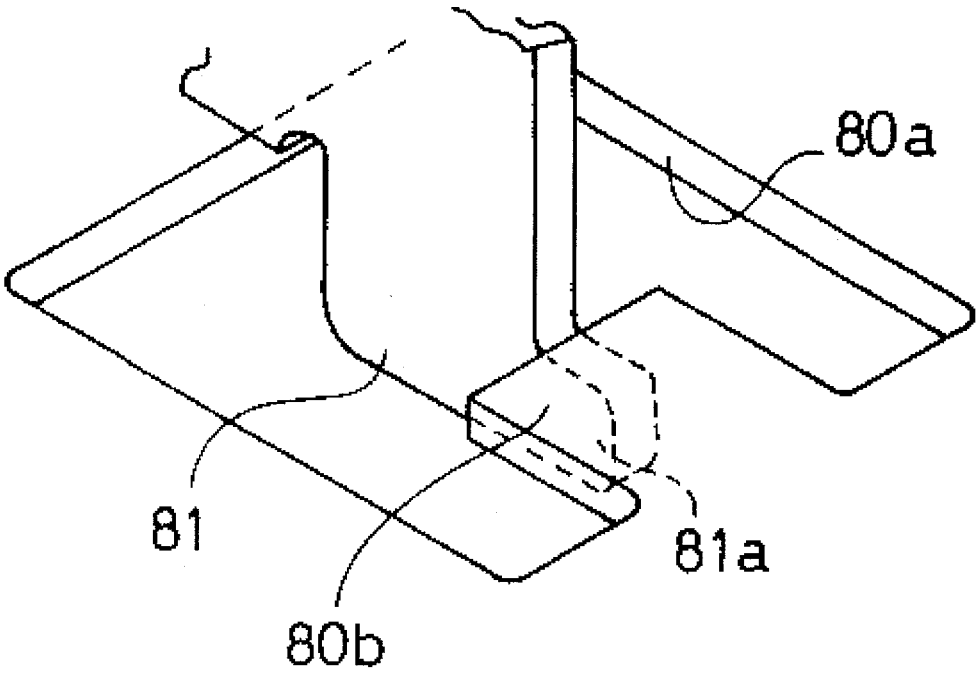
FIG. 14 is a perspective partial view showing a latch portion of the mounting frame.

The image fixing and sheet transporting unit 16 is mounted onto the image forming equipment body by installing the frames 53 (referring to FIG. 12) disposed at both ends of the unit onto a mount frame 80, shown in FIG. 13. At the bottom end of each frame 53 are first and second hooks 81 and 82; and on the downstream, discharging side thereof is a flange 83. The mount frame 80 includes a horizontal portion 80*e* into which the frame 53 is placed, and a vertical portion 80*d*. The first hook 81 of the frame 53 includes a projection 81*a* projecting toward the image printing apparatus, and its upper corner is curved. The first hook 81 is inserted into a cutout 80*a* formed in the mount frame 80. Referring to FIG. 14, a latch portion 80*b* protruding into the cutout 80*a* is formed in the mount frame 80, wherein the projection 81*a* of the first hook 81 can abut on the latch portion 80*b*. The latch portion 80*b* is elastically deformable within a predetermined range. Relation of a distance t1 between the upper surface of the projection 81*a* and the under surface of the frame 53, to a thickness t0 of the mount frame 80 is as follows:

$$t0>t1 \text{ (e.g., } t0=1.2 \text{ mm; } t1=1.15 \text{ mm)}$$

Therefore, when the first hook 81 abuts on the latch portion 80*b*, the tip thereof is elastically deformed upward.

Likewise, the second hook 82 includes a projection 82*a* projecting toward the first hook 81. The upper surface 82*b* of the projection 82*a* inclines downward. A cutout 80*c* is formed in the mount frame 80 corresponding to the second hook 82. The cutout 80*c* is formed large enough that the second hook 82 can be entirely inserted into it at once. In addition, relation of a distance t2 between the base of the inclined surface 82*b* and the under surface of the frame 53, to the thickness t0 of the mount frame 80 is as follows:

$t0<t2$ (e.g., $t0=1.2$ mm; $t2=1.3$ mm)

The vertical portion 80d is bent upward from an end of the horizontal portion 80*e*. A threaded hole 84 is formed in the vertical portion 80*d*, wherein the flange 83 of the frame 53 is mounted by a screw 85. As indicated by the dotted line in FIG. 13, when the image fixing and sheet transport unit 16 is installed into the mount frame 80, abutting the second hook 82 against the corresponding edge of the cutout 80*c* of the mount frame 80, a small gap t3 (e.g., 0.1 to 0.5 mm) is left between the flange 83 and the vertical portion 80*d*.

When the image fixing and sheet transporting unit 16 including the frames 53 is installed into the mount frame 80 of the image forming equipment body, first, both hooks 81 and 82 of each frame 53 are inserted into the cutouts 80*a* and 80*c* of the mount frame 80. Then, the frame 53 is moved rightward in FIG. 13, wherein the projection 82*a* of the second hook 82 is guided downward as its inclined surface 82*b* rides on the edge of the cutout 80*c*. The projection 81*a* of the first hook 81 goes under the latch portion 80*b*. Thus, the image fixing and sheet transport unit 16 can be temporarily set in the vertical direction merely by shifting the frame 53 laterally.

Wherein the unit 16 is temporarily set, the gap t3 is formed between the vertical portion 80*d*of the mount frame 80 and the flange 83 of the frame 53. In this state, if the screw 85 is screwed down tight into the threaded hole 84, the flange 83 is deflected and adhered Immediate the vertical portion 80*d*. Thus, the fixing and transporting unit 16 is stably fixed to the mount frame 80 by the elastic force arising from the deflection of the flange 83.

By utilizing the above-described frame 53 and mount frame 80, even wherein the frame 53 cannot be fixedly set from above, which is the mounting direction, by screws, it can be nonetheless readily positioned and securely mounted.

Pressed Contact and Pressure Release between Fixing Roller Pair

Figure 15:
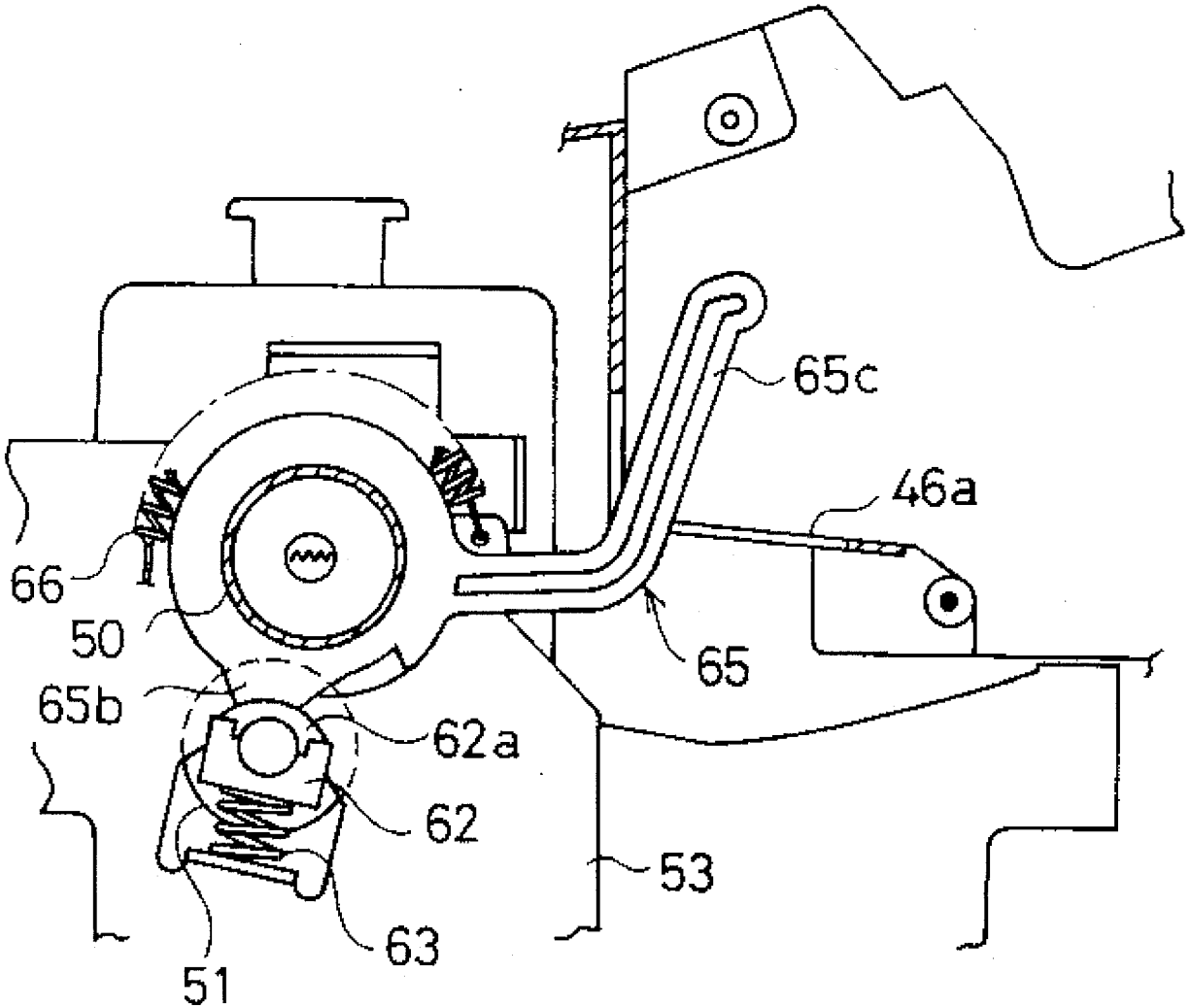
FIG. 15 is an elevational view showing the unit when in position for shipping.

In the state in which the imaging unit 11 is not in installation, for example when shipped, as shown in FIG. 15 according to the above embodiment of the present invention, the lever arms 65*c* of the pressure releasing lever 65 are passed through the cutouts 46*a* of the middle frame 46, rotated upward. Therein, the lever arms 65*c* are held turned counterclockwise in FIG. 15 by the impelling force of the spring 66. In this state, the cam 65*b* of the pressure releasing lever 65 is forced into abutment on the knob 62*a*, pushing the bearing 62 and thus pressure roller 51 downward against the impelling force of the spring 63, thereby separating the pressure roller 51 from the heating roller 50.

Meanwhile, when the image forming equipment of the facsimile terminal is set up, the upper case 25 is opened and the imaging unit 11 is installed. Then, when the upper case 25 is closed, as shown in FIG. 3, the lever arms 65*c* are pushed downward by the bottom surface of the housing 30 containing the imaging unit 11. Therein, the pressure releasing levers 65 are rotated clockwise in FIG. 3 against the elastic force of the spring 66, turning (each) cam 65*b* off of the bearing 62 knobs 62*a* supporting the pressure roller 51. Thereupon, the pressure roller 51 is impelled upward by the spring 63, whereby the rollers 50 and 51 are pressed together.

Furthermore, the bottom portion of the imaging unit 11 is pushed upward by the lever arms 65*c* of the pressure releasing levers 65, locking the retainers 33 of the housing 30 into position abutting on the pins 34. When the imaging unit 11 is to be replaced, the upper case 25 is opened, releasing pressure from the lever arms 65*c* such that the gap between the photoconductive drum 35 and the developing roller 12 is increased, preventing collision between the developing roller 12 and the photoconductive drum 35 as the imaging unit 11 is installed or dismounted.

Thus, since the heating roller 50 automatically presses against the pressure roller 51 through the mounting operation of the imaging unit 11, setting up time is reduced in comparison with conventional equipment using, for example, a shipping spacer to separate the rollers. Additionally, problems caused by error in installation are avoided. Furthermore, since the rotation center of the pressure releasing levers 65 coincides with the axis of the heating roller 50, an axial rod for the lever 65 is not necessary, simplifying the pressure-releasing mechanism. Moreover, providing the cam 65*b* with a gentle slope separates the roller pair with a small force through the rotation of the pressure-releasing mechanism.

Figure 16:
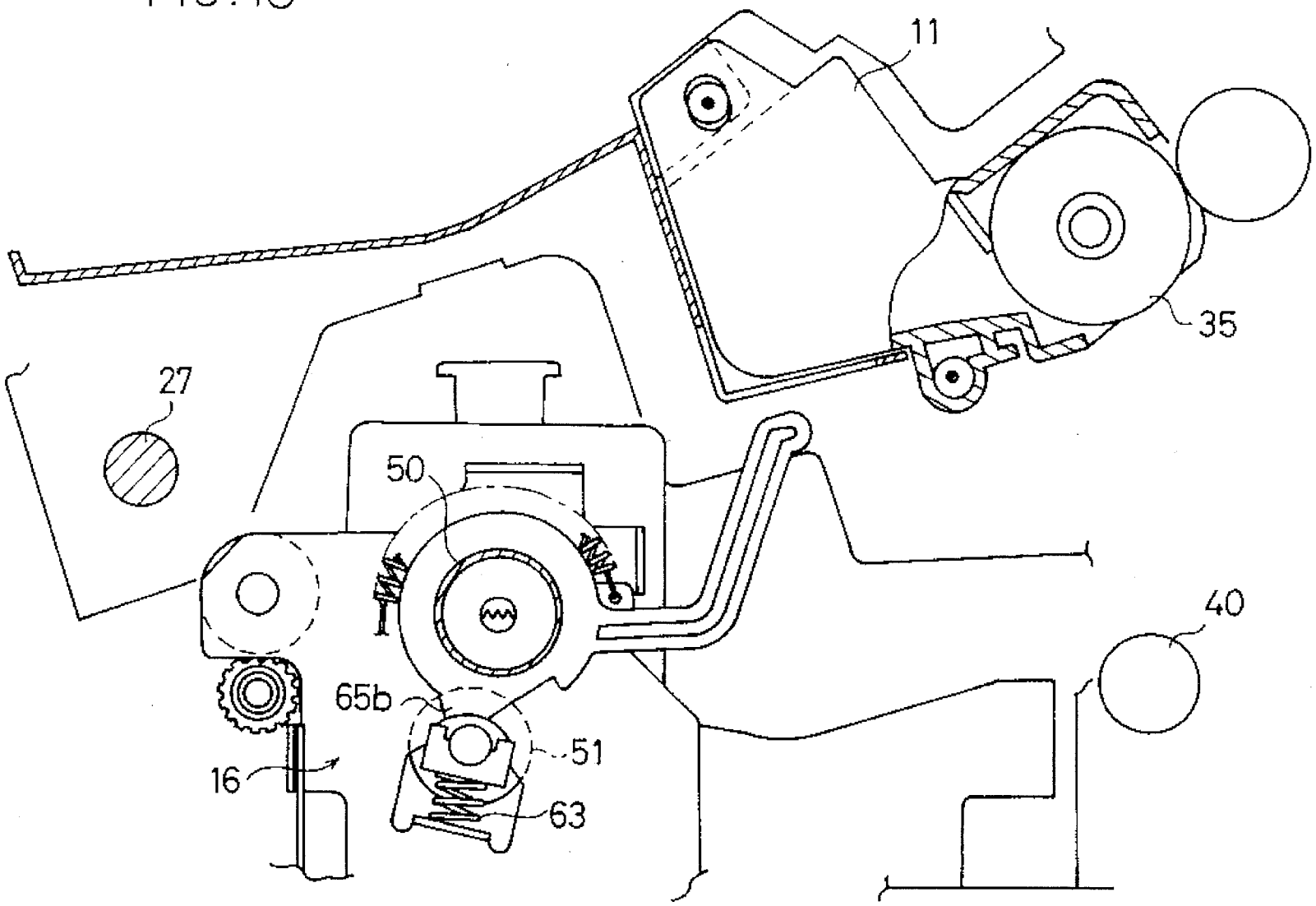
FIG. 16 is an elevational view showing positioning of the unit wherein a sheet jam is being remedied.

When a sheet becomes jammed in the image fixing and sheet transport unit 16, the upper case 25 is opened as shown in FIG. 16. In this case, since the bottom surface of the housing 30 of the imaging unit 11 is parted from the ends of the lever arms 65*c* of the pressure releasing levers 65, the pressure releasing levers 65 are rotated counterclockwise in FIG. 16, as is likewise the case wherein the imaging unit 11 is not in installation. When the pressure roller 51 is further parted from the heating roller 50, the release arm 88 holding the axle 61 of the pressure roller 51 is rotated clockwise in FIG. 10. The oblique surface 88*b* at the upper end of the release arm 88 then pushes the mid-shaft 79 upward, whereby the middle gear 78*c* is moved upward against the impelling force of the spring 87. Therefore, the middle gear 78*c* is disengaged from the follower gear 78*b*, whereby the sheet discharge roller 75 is rotatable.

In this state, the sheet jammed in the image fixing and sheet transport unit 14 can be readily removed either from within or without the image forming equipment. Furthermore, the mechanism for setting the sheet discharge roller 75 into its free state is simple and inexpensive, as compared with a case wherein a magnetic clutch or one-way clutch is provided. Furthermore, since it is not necessary to provide the sheet discharge roller 75 on the upper case 25 to enable pressure release, the discharge roller can be disposed without needing to take a pivotal support point of the case into consideration, increasing design freedom to a degree.

Image Forming Operation and Transporting Operation

When the facsimile terminal receives information, the laser unit 15 optically discharges the electrostatically charged surface of the photoconductive drum 35, forming an according latent image thereon. The electrostatic latent image is developed as a toner image by the developing unit 14. The toner image is transferred onto the surface of the printing sheet by the transfer roller 40.

The sheet is introduced into the image fixing and sheet transport unit 16 along the sheet transport guide 45. Meanwhile, positively charged residual toner is collected in the residual toner container 37 defined by the housing 30 of the imaging unit 11. The sheet in being passed through the transfer roller 40 is charged with electricity of polarity opposite that of the toner. If the transfer guide 45 were a good conductor, it would abruptly drain the electric charge on the sheet, breaking adhesion of the unfixed toner to the sheet, and thus damaging in transport the image carried on its surface. In this embodiment of the present invention, however, since the sheet transport guide 45 is formed of a resin having a controlled conductivity, the surface resistivity being within the range previously mentioned, the electric charge on the sheet is drained only gradually through the sheet transport guide 45. Thus, damage to the unfixed toner image is prevented. In tilts embodiment particularly, since the sheet transport guide 45 is of greater length, wherein its surface resistivity is set at the specified value, damage to the unfixed toner-printed image due to abrupt draining of the electric charge during transportation is prevented.

Residual toner collected in the container 87 of the housing 30 is positively charged. In addition, since the middle frame 46 is grounded, the middle frame 46 is negatively charged by electrostatic induction. Since the negative charge on the sheet traveling on the sheet transport guide 45 drains gradually as described above, electrostatic attraction between the sheet and the residual toner in the container 37 is reduced, whereby the sheet is prevented from curling upward. Consequently, sheet transport is stabilized.

The thus transported sheet is guided to the upper admission guides 52*e* and 71*a* of the catch 71 in the upper housing 52, wherein it is introduced between the heating roller 50 and the pressure roller 51. Since the surface resistivity of the lower sheet admission guide 49 is very small ($10^2\Omega$) as specified above, it strips electric charge on the leading edge of the sheet, checking electrical repulsion of the sheet by the lower sheet admission guide 49, and consequently preventing the leading edge of the sheet from colliding with the circumferential surface of the heating roller 50.

In a state wherein the leading edge of the sheet is nipped by the fixing roller pair 50 and 51, the remainder of the sheet will be curved downward along the surface of the transport guide 45. Then, when the fixing roller pair 50 and 51 begins to transport the sheet, since the transporting speed of the roller pair 50 and 51 is higher than that of the resist rollers 23 as described above, the sheet is gradually straightened becoming completely straight when the trailing edge of the sheet is parted from the resist rollers 23.

In this embodiment, when the leading edge of the sheet is nipped by the roller pair 50 and 51, since they then transport the sheet at a slightly higher speed as described above, the sheet except for its leading edge is lifted from the upper surface of the lower sheet admission guide 49. Consequently, electric charge on the remaining, image-printing region of the sheet is not drained through the lower sheet admission guide 49, preventing abrupt adhesion of the toner to the sheet, which could otherwise cause damage to the image.

If the sheet were curved when the trailing edge of the sheet departs the resist rollers 23, the sheet would curl upward due to its stiffness, such that the sheet would not set correctly in the image printing apparatus, possibly causing damage to the image. In this embodiment of the present invention, however, since the sheet is straight when the trailing edge of the sheet leaves the resist rollers 23, the sheet is oriented correctly in the image printing apparatus.

Subsequently, the sheet is heated and the toner image carried on the sheet surface is fixed while the sheet is nipped by the fixing roller pair 50 and 51 at a predetermined pressure.

In this fixing operation, since the sheet normally contains a large amount of water and the heating roller is heated to 150° C. or more, vapor is generated from the sheet in passing the heating roller 50. If this vapor reaches the partition 47 wherein the image forming equipment has not sufficiently warmed up, dew condensation forms along the underside of the dihedral surfaces 47*a* and 47*b* and collects on the collecting surface 47*c* over the mounting member 54. Condensation then drops from the collecting surface 47*c*, and is collected into the channel 54*a* of the mounting member 54.

The channel 54*a* of the mounting member 54 is immediate the heating roller 50. Therefore, wherein the printing operation continues, the water in the recess 54*a* is evaporated by heat from the heating roller 50. By this time, since the image forming equipment has warmed up sufficiently, any vapor reaching the partition 47 again will not condense into dew.

If the water storing capacity of the mounting member 54 channel 54*a* is sufficient to enable it to store the greatest quantity of dew condensation therein possible under normal operating conditions, no water drops will fall onto other items, such as the surface of the printing sheet, ensuring that water damage to the Image is prevented. Moreover, employing the partition 47 and the mounting member 54 eliminates the need to use a special element such as a hygroscopic material.

After the printing sheet has undergone the image fixing operation, it is separated from the heating roller 50 by the separating claws 57 and then discharged onto the discharge tray by the discharge rollers 75 and 76. Therein, the trailing edge of the sheet enters a groove 76*a* of the lower roller 76, as shown In FIG. 9. Since the adjacent side of the groove 76*a* makes an acute angle with the line tangent to the cylindrical periphery, the trailing edge of the sheet further enters inside the groove 76*a* following the rotation of the lower roller 76. Thereby, the sheet is securely discharged into the discharge tray 17. In addition, since the bottom of the groove 76*a* is arced, the sheet is further protected from being damaged.

[Modifications]

(a) Although the lever arm 65*c* of the pressure releasing lever 65 directly abuts on the bottom surface of the imaging unit 11 in the above embodiment of the present invention, it may abut on another member.

Figure 17:
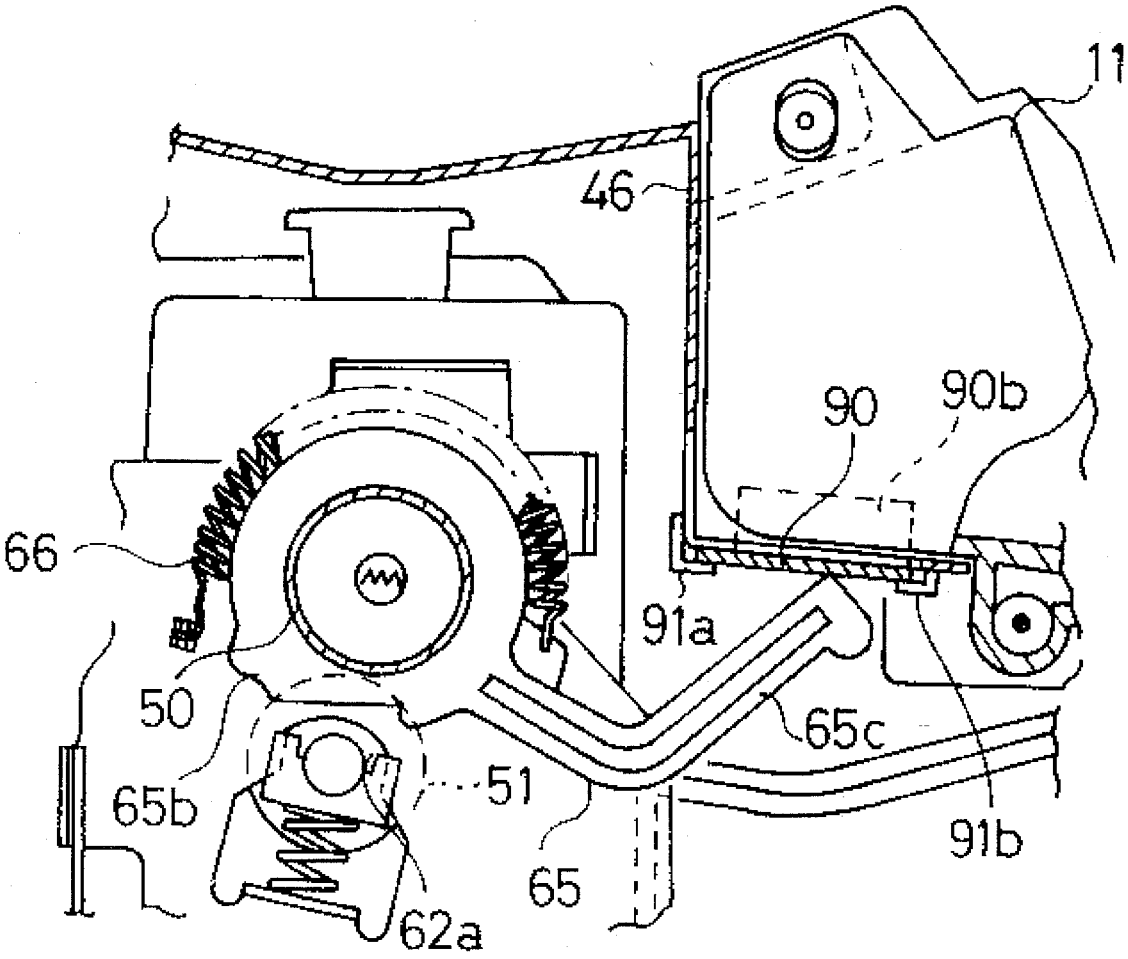
FIG. 17 is an enlarged elevational partial view illustrating a portion of an image fixing and sheet transporting unit according to another embodiment of the present invention.
Figure 18:
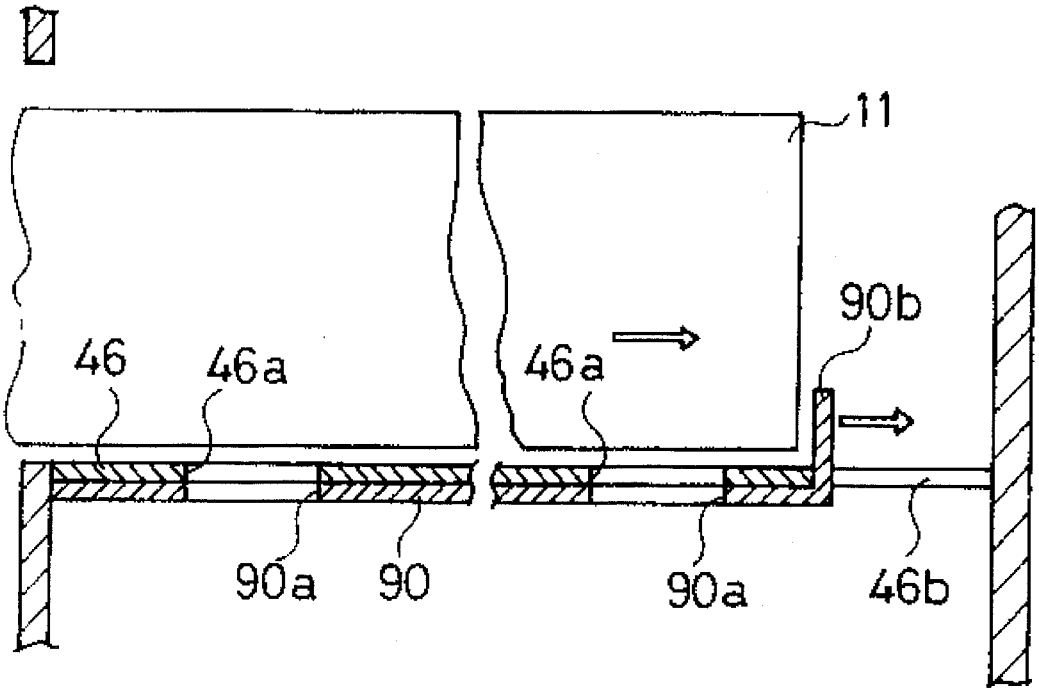
FIG. 18 is a partial end view corresponding to FIG. 14.

According to an embodiment of the present invention as shown in FIGS. 17 and 18, a shutter member 90 is supported by guides 91*a* and 91*b* provided on the lower surface of the middle frame 46, and is movable in the axial direction of the heating roller 50. A pair of cutouts 90*a* is formed in portions of the shutter member 90 corresponding to the cutouts 46*a* of the middle frame 46. Each cutout 90*a* is almost the same size as the cutout 46*a*. Therefore, the cutout 46*a* of the middle frame 46 coincides with the cutout 90*a* of the shutter member 90 in the position shown in FIG. 18, whereby the lever arm 65*c* can pass through both cutouts 46*a* and 90*a*. Furthermore, an upward projecting bracket 90*b* is formed at one end of the shutter member 90. When the imaging unit 11 is installed into the image forming equipment body, the adjacent end of the imaging unit 11 abuts on the bracket 90*b* of the shutter member 90 such that the shutter member 90 is moved in the direction indicated by the arrow in FIG. 18. Thereupon, the cutout 46*a* of the middle frame 46 is shifted off of the cutout 90*a* of the shutter member 90, and the lever arm 65*c* abuts on the shutter member 90 wherein it cannot rotate upward.

In this state, as shown in FIG. 17, the cam 65*b* of each pressure releasing lever 65 is separated from the bearing knob 62*a* supporting the pressure roller 51, allowing the rollers 50 and 51 to be pressed together.

If the imaging unit 11 is of low rigidity, wherein the lever arm 65*c* of the pressure releasing lever 65 abuts directly on the imaging unit 11 as in the above-described embodiment of the present invention, the imaging unit 11 might be deformed by elastic force of the spring 66, which can have an adverse effect upon image formation. In the embodiment of the present invention shown in FIGS. 17 and 18, however, the lever arm 65*c* abuts on the shutter member 90 and does not directly abut on the imaging unit 11. Therefore, even if the rigidity of the imaging unit 11 is low, the pressure roller 51 is automatically separated from the heating roller 50 without risk of adverse consequences upon image formation.

Figure 19:
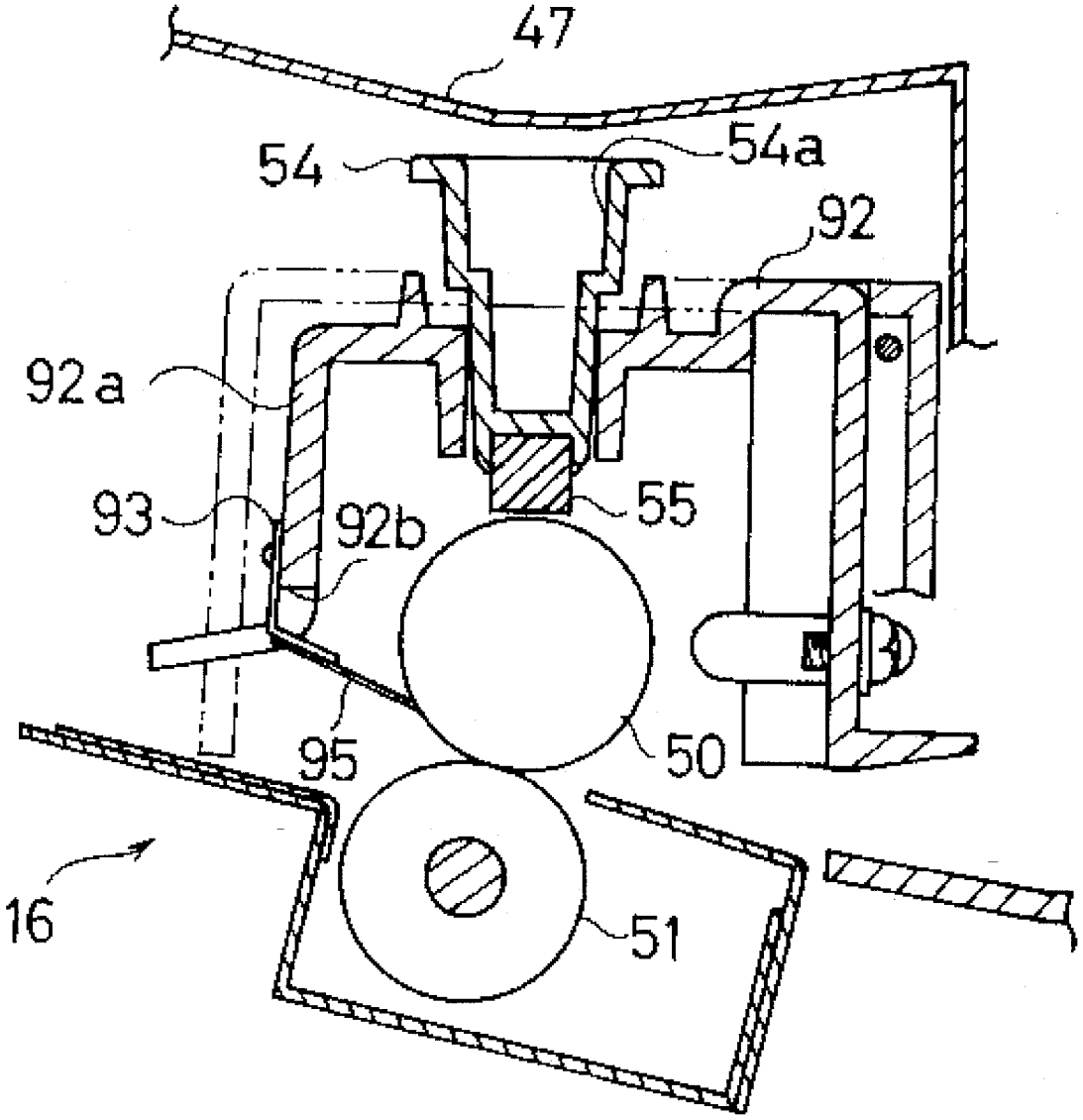
FIG. 19 is a partial view in vertical section of an image fixing and sheet transporting unit according to a further embodiment of the present invention.
Figure 20:
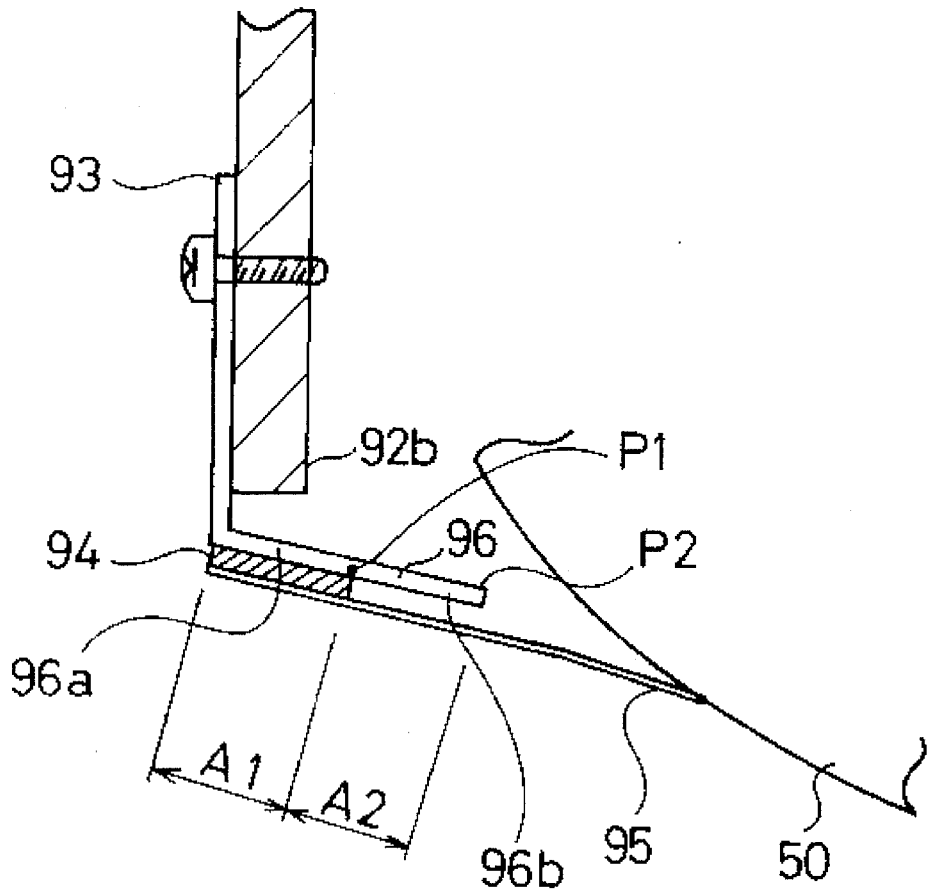
FIG. 20 is a detailed partial enlargement corresponding to FIG. 16.
Figure 21:
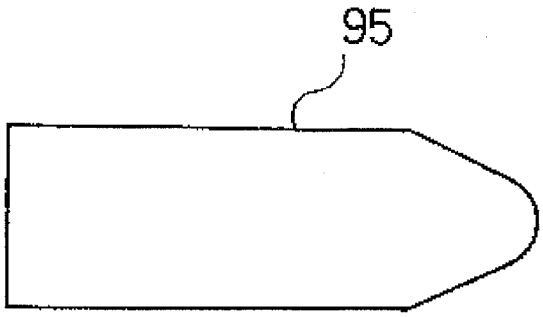
FIG. 21 is a bottom view of a separating claw illustrated in FIG. 17.

(b) Another embodiment of the present invention directed to the separator claw for separating the printing sheet from the heating roller is shown in FIGS. 19 to 21.

According to this embodiment of the present invention, a cutout 92*b* is formed in a lateral wall 92*b* on the downstream, sheet-discharging side of upper housing 92. An L-shaped support member 93 is fixed to the lateral wall 92*a*. A lower portion 96 of the support member 93 passes through the cutout 92*b* and extends into the upper housing 92. A bottom end of a separator claw 95 for separating the sheet from the heating roller is adhered by an adhesive agent 94 to a fixing portion 96*a* (region A1), which is the downstream half of the lower portion 96 of the support member 93. An extension 96*b* (region A2), which is the remaining half of the lower portion 96, upstream toward the sheet-incoming side, is disposed at a predetermined distance from the separating claw 95.

The separating claw 95 is formed of a heat resistant resin sheet such as polyimide and the lower surface thereof opposite the sheet is coated with a fluorocarbon resin. The upper surface of the separating claw 95 is uncoated since it is adhered to the fixing portion 96*a*. The separating claw 95 is preferably 70 μm to 250 μm in thickness. The tip of the separating claw 95 tapers to an arc and is elastically in contact with the surface of the heating roller 50. Therefore, this ensures that even if the mounting position of the separating claw 95 is moved, the tip end of the separating claw 95 will abut on the surface of the heating roller 50 at one point, in order to strip the printing sheet smoothly off the heating roller 50.

According to the above embodiment of the present invention, the printing sheet tending to wind round the heating roller 50 is separated therefrom by the separating claw 95 and then transported toward the discharge roller. Therein, the pressing force of the separating claw 95 against the heating roller 50, which can be relatively small, is determined by the distance between a support point P1, which is the end of the fixing portion 96*a*, and the tip end of the separating claw 95; thus, the heating roller 50 is not likely to be worn away, prolonging its life.

Moreover, wherein the printing sheet is stiff, or wherein it becomes jammed, the separating claw 95 is pushed upward and the middle portion thereof abuts on a support point P2, which is the end of the extension portion 96*b*. In this case, the elastic force of the separating claw 95 is determined by the relatively short distance between the support point P2 and the tip end of the separating claw. Thus, a relatively strong force is needed to deflect the separating claw 95 further upward. More specifically, by means of the separating claw 95 and the support member 93, the separating claw 95 is prevented from being curled upward, without increase in the pressing force of the separating claw on the heating roller 50.

Since the lower surface of the separating claw 95 is coated with fluorine, the separating claw is not likely to be polluted by the toner nor by paper powder. As a result, stable separating performance obtains over a long period of time.

Figure 22:
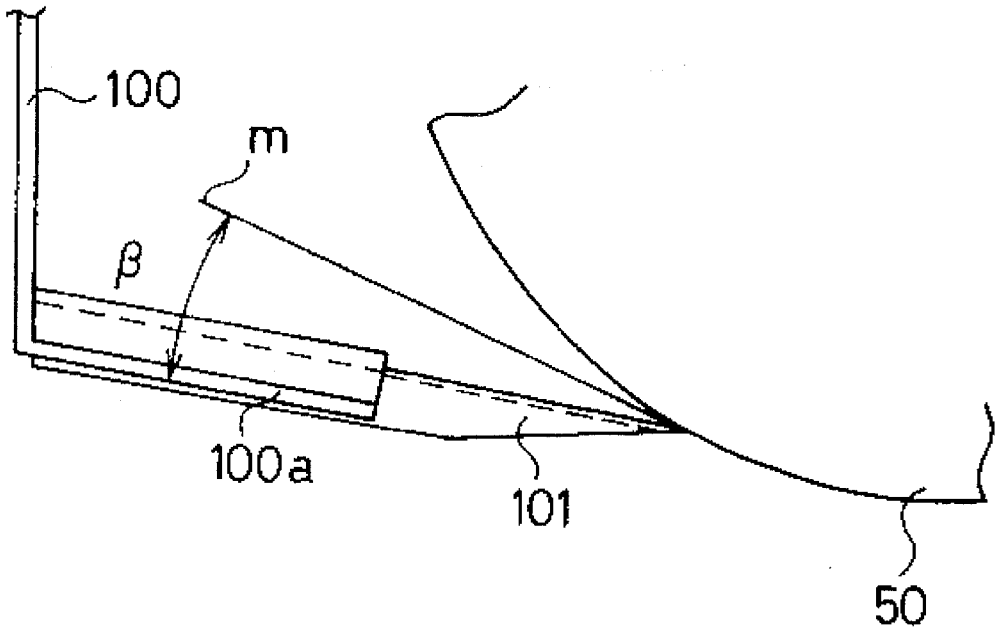
FIG. 22 is a view in detailed partial enlargement illustrating part of an image fixing and sheet transporting unit according to a still further embodiment of the present invention.
Figure 23:
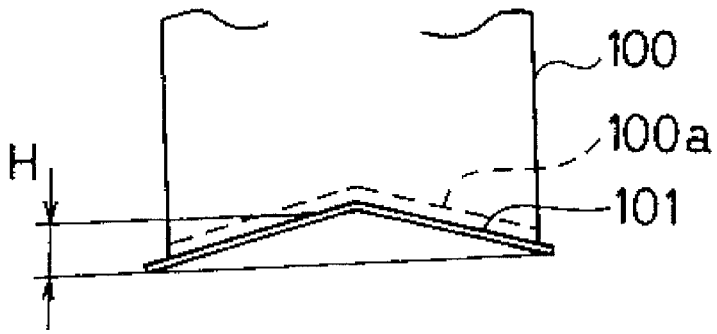
FIG. 23 is an end view corresponding to FIG. 19.
Figure 24:
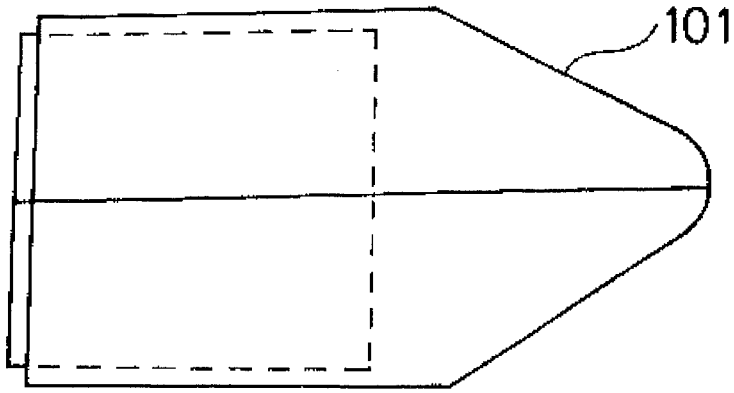
FIG. 24 is a bottom view corresponding to FIG. 20.

(c) A separating claw according to still another embodiment of the present invention is shown in FIGS. 22 to 24.

According to this embodiment of the present invention, an under surface 100*a* of a support member 100 is cut in an inverted V as shown in FIG. 23, in which the center thereof is higher than either edge by H. A separating claw 101 is also shaped in an inverted V along the lower portion 100*a* of the support member 100. The tip end of the separating claw 101 tapers into an arc as shown in FIG. 24. The separating claw 101 is mounted in such a manner that an angle β (which is formed between the separating claw 101 and a tangent line of the heating roller 50) is in the range $5° < \beta < 45°$.

In this embodiment, since the separating claw 101 is bent in such a manner that the center thereof is higher, the elastic force pressing it to the heating roller 50 is greater than the elastic force effective in the direction tending to part it from the heating roller 50, whereby the separating claw 101 is prevented from being curled upward, without increasing the force pressing it to the heating roller 50.

In addition, since the separating claw 101 is in contact with the heating roller 50 at the angle $\beta(5° < \beta < 45°)$, even when the printing sheet is thick or stiff, the sheet is smoothly stripped from the heating roller 50.

The shape of the separating claw 101 is not limited to the example shown in FIG. 23, and may be bent in an arc, for example.

Figure 25:
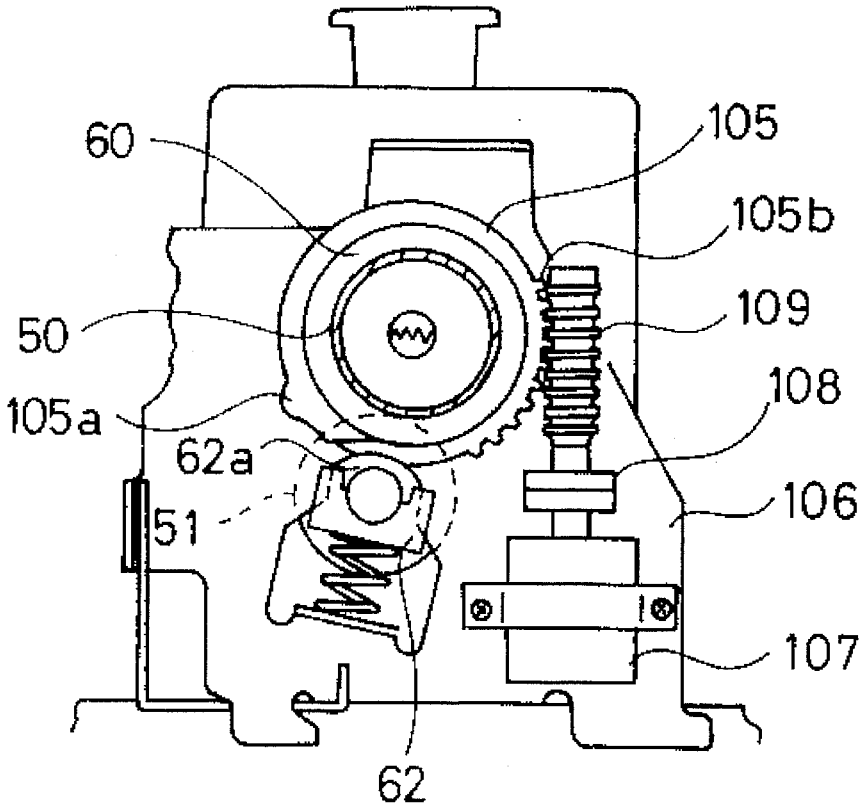
FIG. 25 is a partial elevational view showing part of an image fixing and sheet transporting unit according to a still further embodiment of the present invention.

(d) Although the pressure releasing lever is rotated by pressing force from the imaging unit 11 or the like in installation in the foregoing embodiments of the present invention, it may be rotated by a driving mechanism such as a motor and a gear train as shown in FIG. 25.

According to the embodiment shown in FIG. 25, a pressure releasing member 105 is rotatably disposed peripherally around the bearing 60 supporting the heating roller 50, and it circumferentially carries a cam 105*b* for pressing the knob 62*a* of the pressure roller 51 bearing 62. In addition, a gear portion 105*b* is formed in the circumferential periphery of the pressure releasing member 105. Furthermore, a motor 107 is fixed to the frame 106 and a worm gear 109 is connected to an end of the shaft of the motor 107 through a coupler 108. The worm gear 109 is engaged with the gear portion 105*b* of the pressure releasing member 105.

According to the above embodiment of the present invention, the pressure releasing member 105 can be rotated around the heating roller 50 by rotation of the worm gear 109 by the motor 107. Therefore, when the cam 105*b* of the pressure releasing member 105 is brought into abutment on the bearing knob 62*a* following the rotation of the pressure releasing member 105, the pressure roller 51 is separated from the heating roller 50.

According to the above embodiment of the present invention, since a lever is not necessary, the heating roller 50 and the pressure roller 51 can easily presses together or separated in compact space.

Figure 26:
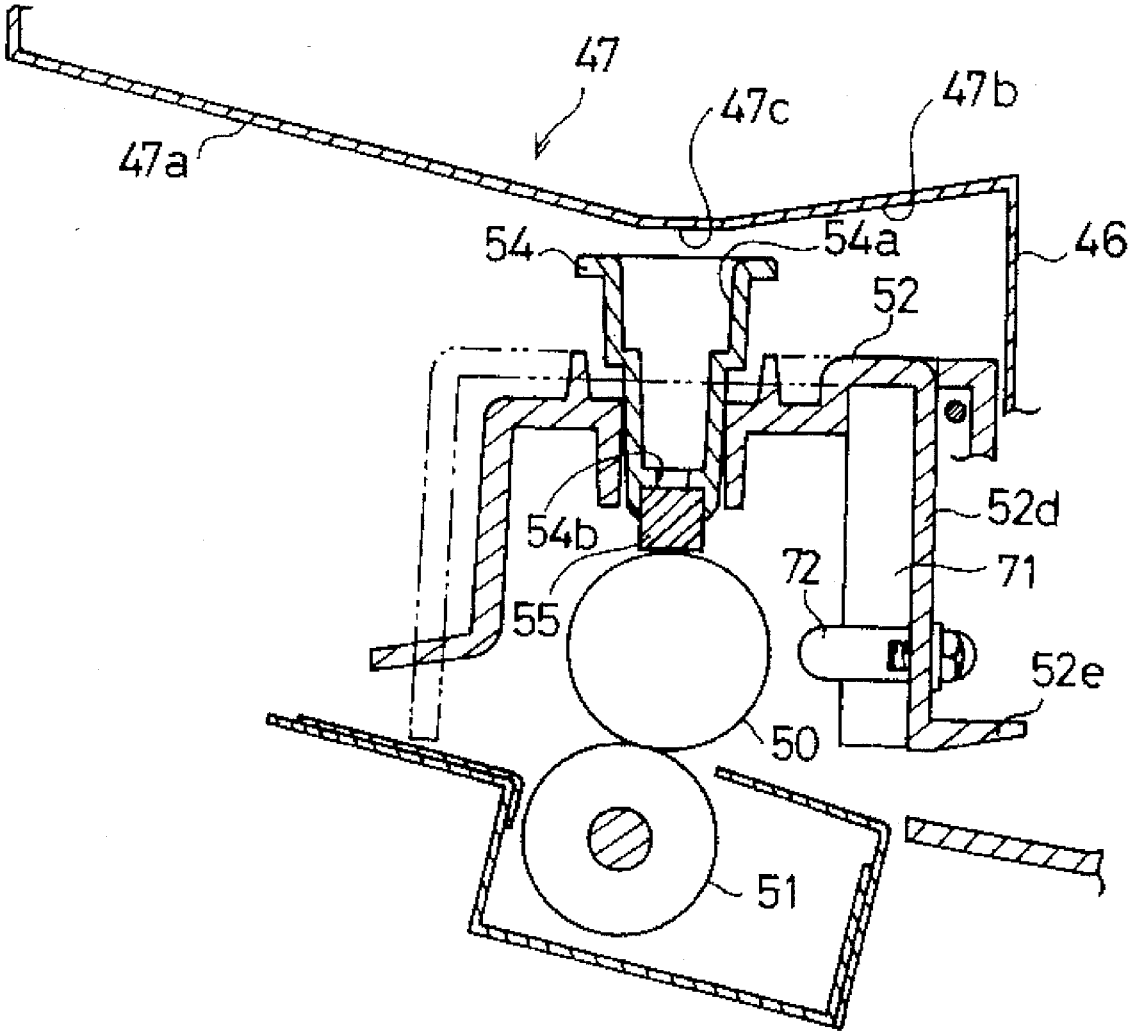
FIG. 26 is a partial view in vertical section of an image fixing and sheet transporting unit according to a still further embodiment of the present invention.

(e) Referring to FIG. 26, a hole 54*b* may be formed in a portion of the bottom of the channel 54*a* of the mounting member 54.

According to the above embodiment of the present invention, water condensation dropping into the channel 54*a* passes through the hole 54*b* and soaks into the cleaning member 55. Since the cleaning member 55 is in contact with the surface of the heating roller 50, it is heated, thus quickly evaporating the water condensation.

Figure 27:
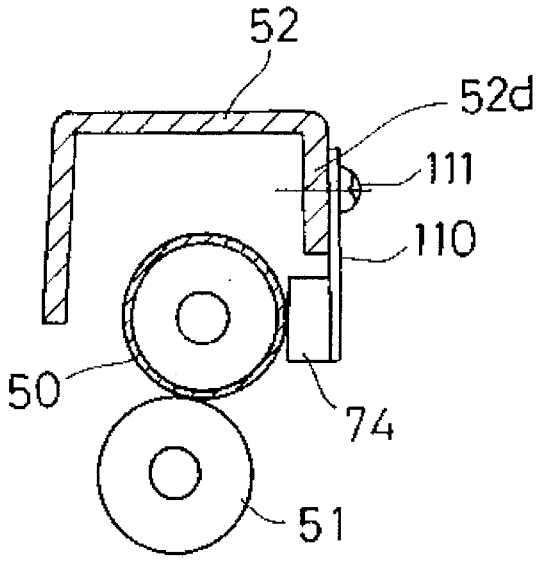
FIG. 27 is a schematic sectional view illustrating a thermistor mounting element according to a modified embodiment of the present invention.

(f) Although thermal deformation of the upper housing 52 on which the thermistor 74 is mounted is prevented by the cover 59 including the ribs 59*a* in the above embodiment of the present invention, the thermistor 74 may be prevented from being shifted by forming the thermistor mounting element 110 as illustrated in FIG. 27 of a shape memory alloy.

More specifically, in the embodied modification shown in FIG. 27, the mounting element 110 is mounted in the lateral wall 52*d* of the upper housing 52 by screws 111. The mounting element 110 is formed of a shape memory alloy and the thermistor 74 is fixed to the lower end thereof.

Figure 28:
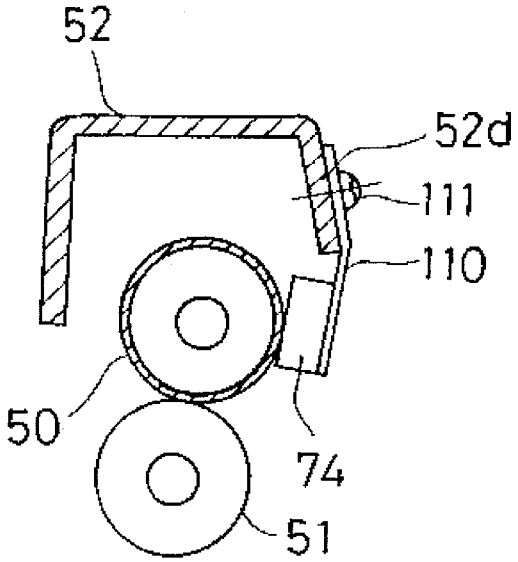
FIG. 28 is a view corresponding to FIG. 27, illustrating deformation of the thermistor mounting element at high temperature.

According to this embodiment of the present invention, the mounting element 110 is rectilinear at a heat-resistant temperature or less of the upper housing 52, at that time the thermistor 74 fixed to the lower end thereof is in contact with the heating roller 50 as shown in FIG. 27. On the other hand, if the lateral wall 52*d* is deformed outward due to an abnormal rise in temperature, as shown in FIG. 28, the mounting element 110 assumes a previously shaped form. In particular, the end of the mounting element 110 warps toward the heating roller 50 so as to offset the deformation of the lateral wall 52*d*. Consequently, even if the lateral wall 52*d* is deformed outward, the thermistor 74 can be kept in contact with the heating roller 50. Thus, the surface temperature of the heating roller 50 can be precisely detected and a normal temperature adjustment can be made.

Figure 29:
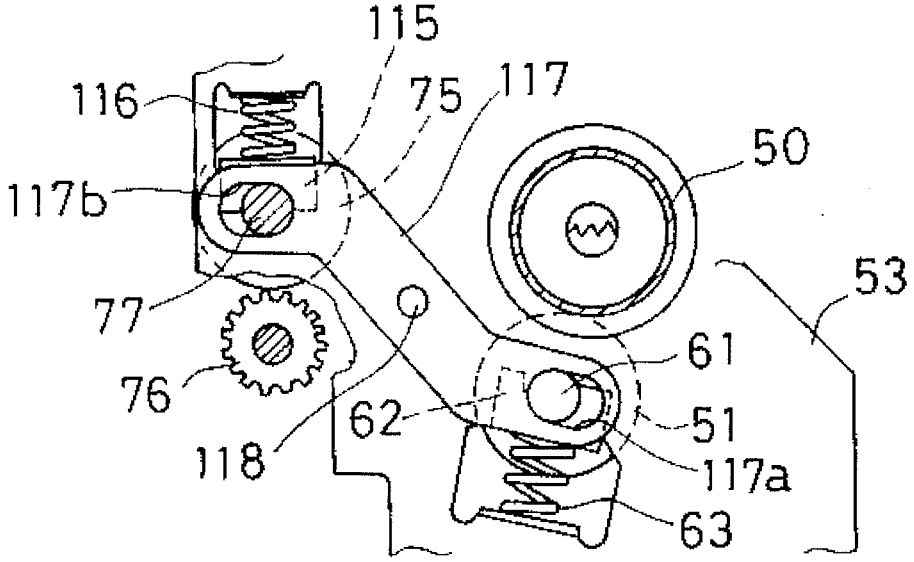
FIG. 29 is a rear partial view showing details of a mechanism for releasing the impelling force on the pair of sheet discharge rollers in the image fixing and sheet transport unit according to another modified embodiment of the present invention.

(g) Another example of a mechanism for releasing impelling force on the discharge rollers is shown in FIG. 29.

In this example, a drive shaft 77 to which a discharge upper roller 75 is fixed is vertically shiftable. More specifically, the drive shaft 77 is rotatably supported by a bearing 115, and the bearing 115 is vertically shiftable in the fixing unit frame 53. In addition, the bearing 115 is constantly impelled downward by a spring 116. Meanwhile, a releasing arm 117 is rotatably mounted to the frame 53 on a pin 18. Slots 117*a* and 117*b* are formed at respective ends of the releasing arm 117. Axle 61 of the pressure roller 51 is held in the slot 117*a* and the drive shaft 77 of the discharge upper roller 75 is held in the other slot 117*b*.

According to this embodiment of the present invention, when the axle 61 is pushed downward to release the pressure of the pressure roller 51, the releasing arm 117 is rotated clockwise around the pin 118. The drive shaft 77 abutting on the upper end of the releasing arm 117 is thereby lifted against the impelling force of the spring 116. Thus, a sheet jammed between the discharge rollers 75 and 76 is freed and can be withdrawn from within or without the image forming equipment.

In this case also, the driving force of the discharge roller pair 75 and 76 can be released by means of a structure which is inexpensive in comparison with a magnetic or one-way clutch.

(h) Superficial resistivities of the sheet transport guide 45 and the lower sheet admission guide 49 were given in the foregoing description, generally however, the relation of the superficial resistivity of the transport guide 45 to that of the lower admission guide 49 and the heating roller 50 is preferably:

transport guide ≧ lower admission guide ≧ heating roller wherein each superficial resistivity is within the range of $10^7$ to $10^{14}\Omega$. For example, the transport guide 45 and the lower admission guide 49 can be formed of a resin having controlled conductivity to have superficial resistivities of $10^{12}\Omega$ and $10^{11}\Omega$, respectively, and the heating roller 50 can be coated with conductive PTFE to have a superficial resistivity of $10^8\Omega$.

In this case, since electric charge on the sheet is gradually drained as the sheet is transported, abrupt shifting of, the electric charge is consequently prevented preventing damage to the toner image on the sheet.

Figure 30:
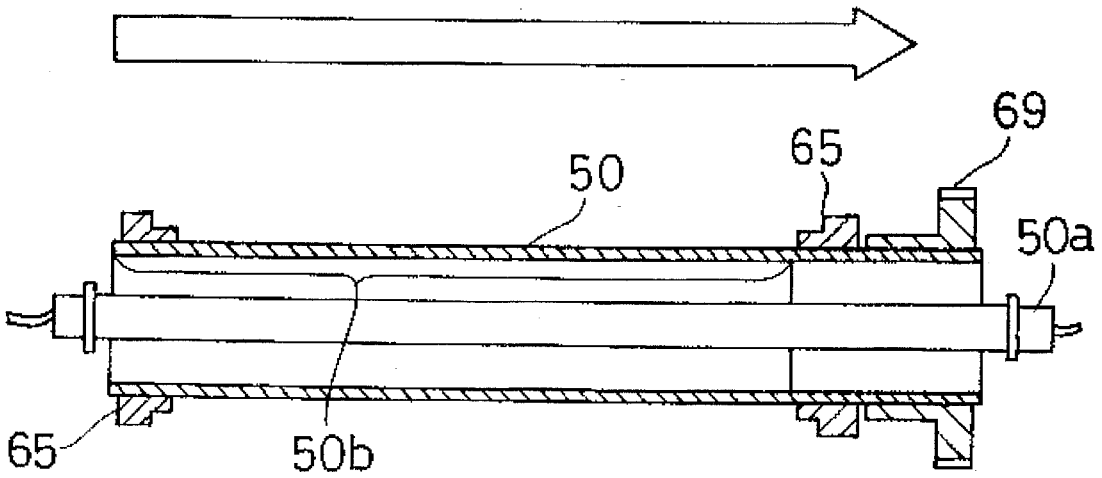
FIG. 30 is a partially cut away lateral view of a heating roller of the image fixing and sheet transport unit according to still another modified embodiment of the present invention.

(i) Although heat distribution characteristics of the heater 50*a* are such that the quantity of heat emitted is greater toward the front and less toward the rear in the above embodiment of the present invention, if the heat distribution characteristics of the heater 50*a* are uniform, an endothermic layer may be formed by coating a region 50*b* as shown in FIG. 30 on the interior surface of the heating roller 50 toward the front with a black layer having, for example, thermal absorption properties and heat-resistant properties. The region 50*b* is provided forward of the pinion gear 69. Thus, coefficient of heat conductivity in the region 50*b* is higher than that in the non-coated portion, thereby preventing rise in temperature in the non-coated portion. Consequently, unevenness in the surface temperature of the heating roller 50 can be smoothed.

Figure 31:
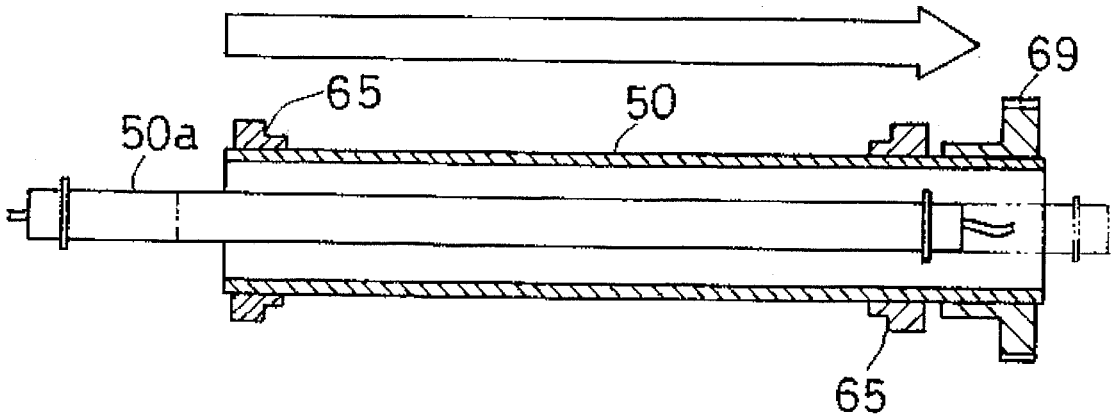
FIG. 31 is a view corresponding to FIG. 30 of a heating roller according to yet another modified embodiment of the present invention.

(J) In order to make the surface temperature of the heating roller 50 uniform, the heater 50*a* may be offset axially forward as shown in FIG. 31. In this case, although the quantity of heat emitted in the front is not substantially changed, or is increased, it is reduced in the rear. Consequently, unevenness of temperature on the surface of the heating roller 50 can be moderated.

Figure 32:
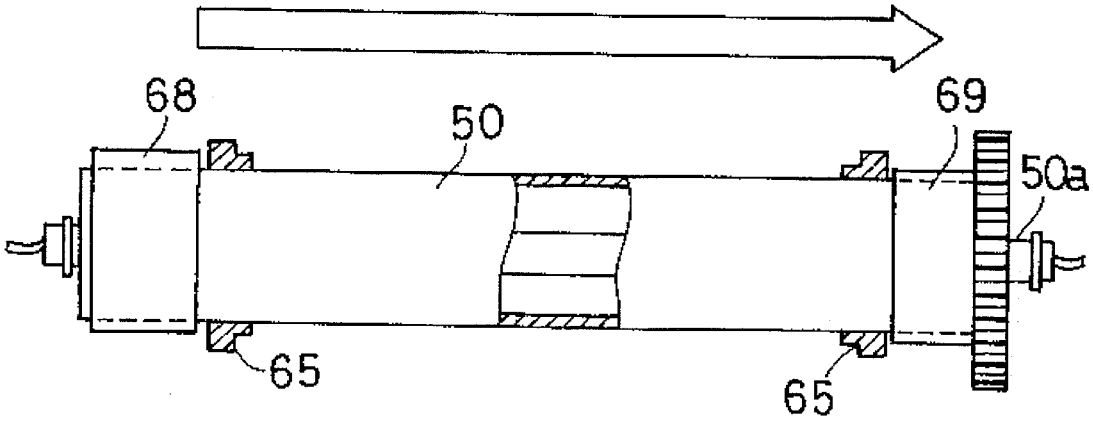
FIG. 32 is a view corresponding to FIG. 30 of a heating roller according to one further modified embodiment of the present invention.

(k) According to still another embodiment of the present invention, as illustrated in FIG. 32 a heater 50*a* having uniform heat distribution characteristics is employed, and in this case, the heating roller 50 protrudes frontward in an extension around which a collar 68 having the same heat insulation properties as the pinion gear 69 is mounted. Therein, the quantity of heat emitted from the heating roller 50 in the rear is the same as that in the front. Furthermore, since the pinion gear 69 and one bearing 65 are disposed on the front side, and the collar 68 and the other bearing 65 are disposed on the rear side, all of which are formed of a heat insulating material, heat loss due to heat dissipation from either end of the heating roller 50 is preventable. Consequently, unevenness of the temperature on the heating roller 50 surface can be mitigated, and rise in temperature in the image forming equipment due to heat dissipation from either end is preventable.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. For an image forming system, a xerographic printing and sheet processing apparatus comprising:

an image printing apparatus for printing superficially onto a sheet an image developed with magnetic toner from a latent image;

an image fixing unit for fixing onto the sheet the toner image printed by said image printing apparatus;

sheet transport guiding means including a transport guide member having a predetermined superficial resistivity, for guiding a sheet from said image printing apparatus to said image fixing unit; and a sheet admission guide member having a superficial resistivity lower than that of said transport guide member, for guiding the sheet transported by said sheet transport guiding means into said image fixing unit.

2. Xerographic printing and sheet processing apparatus according to claim 1, wherein said transport guide member has a superficial resistivity ranging from $1\times10^{10}\Omega$ to $1\times10^{14}\Omega$.

3. Xerographic printing and sheet processing apparatus according to claim 2, wherein said transport guide member is in connection between said image printing apparatus and a sheet inlet of said image fixing unit.

4. Xerographic printing and sheet processing apparatus according to claim 3, wherein said sheet admission guide member is fixed to the sheet inlet of said image fixing unit.

5. Xerographic printing and sheet processing apparatus according to claim 4, wherein said sheet admission guide member has a superficial resistivity of at most $1\times10^{7}\Omega$.

6. Xerographic printing and sheet processing apparatus according to claim 5, wherein said image printing apparatus includes:

a photoconductive drum being electrically charged to have a negative polarity, for bearing said latent image as a positive image formed thereon by optical discharge; wherein said magnetic toner carries an electric charge of positive polarity in developing said latent image; and a transfer roller for transferring said image developed with magnetic toner from said photoconductive drum to said sheet, said sheet being electrically charged to have a negative polarity.

7. Xerographic printing and sheet processing apparatus according to claim 6, wherein said image printing apparatus further includes an imaging unit containing said photoconductive drum; said imaging unit being in electrical contact with a grounded conductive material.

8. Xerographic printing and sheet processing apparatus according to claim 1, wherein said sheet admission guide member is fixed to a sheet inlet of said image fixing unit.

9. Xerographic printing and sheet processing apparatus according to claim 8, wherein said sheet admission guide member has a superficial resistivity of at most $1\times10^{7}\Omega$.

10. Xerographic printing and sheet processing apparatus according to claim 1, wherein said transport guide member and said sheet admission guide member are disposed together forming a sheet transport path having a dip;

said image printing apparatus includes a sheet transport unit for transporting the sheet at a predetermined first transport speed; and said image fixing unit includes a pair of sheet-nipping transport surfaces for transporting the sheet at a second speed higher than said first transport speed.

11. Xerographic printing and sheet processing apparatus according to claim 10, wherein said transport unit includes a pair of sheet-feeding resist rollers; and a pair of fixing rollers in said image fixing unit incorporate said sheet-nipping transport surfaces.

12. Xerographic printing and sheet processing apparatus according to claim 11, wherein said image printing apparatus further includes a photoconductive drum, and a transfer roller disposed adjacent said photoconductive drum; and said transport guide member is in connection between said photoconductive drum and said fixing unit.

13. Xerographic printing and sheet processing apparatus according to claim 12, wherein said pair of fixing rollers is driven at a sheet transport speed $v_f$ satisfying the following equation:

$$V_f=(L-\lambda-\lambda_a)V_d/(L-\lambda'-\lambda_a);$$

wherein

L is overall sheet length, $\lambda_a$, is a sheet transport distance between said photoconductive drum and said pair of resist rollers, $\lambda'$ is distance in a straight line between said photoconductive drum and said pair of fixing rollers, $\lambda$ is a distance between the photoconductive drum and said pair of fixing rollers along said sheet transport path, and $V_d$ is a circumferential speed at which the pair of resist rollers is driven.

14. Xerographic printing and sheet processing apparatus according to claim 13, wherein each of said pair of fixing rollers is formed having an outside diameter determining the sheet transport speed of the pair of fixing rollers such that said sheet transport speed is $(L-\lambda-\lambda_a)/(L-\lambda'-\lambda_a)$ times that of the circumferential speed of said resist rollers.

15. Xerographic printing and sheet processing apparatus according to claim 14, wherein said transport guide member has a superficial resistivity ranging from $1\times10^{10}\Omega$ to $1\times10^{14}\Omega$.

16. Xerographic printing and sheet processing apparatus according to claim 15, wherein said sheet admission guide member is fixed to a sheet inlet of said image fixing unit.

17. Xerographic printing and sheet processing apparatus according to claim 16, wherein said sheet admission guide member has a superficial resistivity of at most $1\times10^{7}\Omega$.

18. For an image forming system, a xerographic printing and sheet processing apparatus comprising:

an image printing apparatus including a sheet transport unit having a pair of sheet-feeding resist rollers for transporting a sheet through said image printing apparatus at a first sheet-transport speed, wherein said image printing apparatus prints superficially onto the sheet transported by said sheet transport unit an image developed with magnetic toner from a latent image;

a fixing unit having image fixing and sheet transport means including a pair of fixing rollers provided in said fixing unit, for fixing the toner image superficially printed onto the sheet by said image printing apparatus while transporting the sheet through said fixing unit at a second sheet-transport speed; and a sheet transport guide member having a guide surface dip, disposed between said image printing apparatus and said fixing unit for guiding the sheet in transport from said image printing apparatus into a first nipping position between said pair of fixing rollers, whereby the sheet is curved along said guide surface dip;

wherein said second sheet-transport speed of said fixing unit is higher than said first sheet-transport speed of said image printing apparatus, by a ratio predetermined such that the curved sheet is drawn flat coincidentally with departure of a trailing edge of the sheet from a second nipping position between said resist rollers.

19. Xerographic printing and sheet processing apparatus according to claim 18, wherein said image printing apparatus further includes a photoconductive drum, and a transfer roller disposed adjacent said photoconductive drum; and said sheet transport guide member is in connection between said photoconductive drum and said fixing unit.

20. Xerographic printing and sheet processing apparatus according to claim 19, said pair of fixing rollers is driven at said second sheet transport speed $V_f$ satisfying the following equation:

$$V_f=(L-\lambda-\lambda_a)V_d/(L-\lambda'-\lambda_a)$$

wherein

L is overall sheet length, $\lambda_a$ is a sheet transport distance between said photoconductive drum and said pair of resist rollers, $\lambda$ is distance in a straight line between said photoconductive drum and said pair of fixing rollers, $\lambda'$ is a distance between the photoconductive drum and said pair of fixing rollers along a sheet transport path, and $V_d$ is said first sheet-transport speed at which the pair of resist rollers is driven.

21. Xerographic printing and sheet processing apparatus according to claim 20, wherein each of said pair of fixing rollers is formed having an outside diameter determining the second sheet transport speed of the pair of fixing rollers such that said second sheet transport speed is $$(L-\lambda-\lambda_a)/(L-\lambda'-\lambda_a)$$

times that of the first sheet-transport speed of said resist rollers.

22. For a xerographic printing and sheet processing apparatus having an image printing apparatus for printing superficially onto a sheet an image developed with magnetic toner from a latent image, an image fixing unit for fixing the superficially printed toner image onto the sheet while transporting the sheet through said image fixing unit, said image fixing unit comprising:

a hollow heating roller, terminally carrying a thermally insulating power transmitting element for transmitting rotational power to the heating roller;

bearing means for rotatably supporting said heating roller;

means disposed pressible against said heating roller, for transporting said sheet while nipping said sheet together with said heating roller; and axial heating means disposed concentrically within said heating roller, having a radiant heat gradient such that said axial heating means emits heat upstream in a cooling air flow in a quantity greater than said axial heating means emits heat downstream in said cooling air flow.

23. An image fixing unit according to claim 22, wherein said hollow heating roller is driven on an axis of rotation disposed to lie in a direction in which cooling air is streamed in a flow through said image fixing unit.

24. An image fixing unit according to claim 23, further including a cooling fan disposed inside said image fixing unit, for streaming the cooling air in a flow from a front side of said image fixing unit to a rear side thereof.

25. An image fixing unit according to claim 24, wherein said radiant heat gradient of said axial heating means is furthermore such that said axial heating means emits heat in quantity greatest frontward of said heating roller, least midway of said heating roller, and greater rearward than midway but less than frontward of said heating roller.

26. An image fixing unit according to claim 25, wherein said axial heating means includes a heater resistance winding having a winding density greatest frontward of said heating roller, least midway of said heating roller, and greater rearward than midway but less than frontward of said heating roller.

27. An image fixing unit according to claim 22, wherein said power transmitting element is a pinion gear formed of a polyamide-imide resin and disposed rearward of said image fixing unit.

28. An image fixing unit according to claim 27, wherein said radiant heat gradient of said axial heating means is furthermore such that said axial heating means emits heat in quantity greatest frontward of said heating roller, least midway of said heating roller, and greater rearward than midway but less than frontward of said heating roller.

29. An image fixing unit according to claim 28, wherein said axial heating means comprises a heater resistance winding having a winding density greatest frontward of said heating roller, least midway of said heating roller, and greater rearward than midway but less than frontward of said heating roller.

30. For a xerographic printing and sheet processing apparatus having an image printing apparatus for printing superficially onto a sheet an image developed with magnetic toner from a latent image, an image fixing unit for fixing the superficially printed toner image onto the sheet while transporting the sheet through said image fixing unit, said image fixing unit comprising:

a hollow heating roller terminally carrying a thermally insulating power transmitting element for transmitting rotational power to the heating roller;

bearing means for rotatably supporting said heating roller;

means disposed pressible against said heating roller, for transporting said sheet while nipping said sheet together with said heating roller; and axial heating means disposed concentrically within said heating roller, for heating said heating roller; and an endothermic layer, formed along a bore surface of said heating roller over a predetermined range from an end of said heating roller opposite said power transmitting element toward said power transmitting element, for controlled thermal absorption of heat emitted by said axial heating means.

31. An image fixing unit according to claim 30, wherein said endothermic layer is a thermally absorptive and heat-resistant black coating.

32. An image fixing unit according to claim 31, wherein said axial heating means is a heater having uniform heat distribution characteristics.

33. An image fixing unit according to claim 32, wherein said power transmitting element is a pinion gear formed of a polyamide-imide resin and disposed rearward of said image fixing unit.

34. An image fixing unit according to claim 33, wherein the predetermined range of said endothermic layer being formed on the bore surface of said heating roller is from said end of said heating roller opposite said power transmitting element to a front of the pinion gear as said power transmitting element.

35. For a xerographic printing and sheet processing apparatus having an image printing apparatus for printing superficially onto a sheet an image developed with magnetic toner from a latent image, an image fixing unit for fixing the superficially printed toner image onto the sheet while transporting the sheet through said image fixing unit, said image fixing unit comprising:

a hollow heating roller terminally carrying a thermally insulating power transmitting element for transmitting rotational power to the heating roller;

bearing means for rotatably supporting said heating roller;

means disposed pressible against said heating roller, for transporting said sheet while nipping said sheet together with said heating roller; and axial heating means for heating said heating roller, disposed concentrically within said heating roller and offset along said heating roller axis away from said power transmitting element.

36. An image fixing unit according to claim 35, wherein said power transmitting element is a pinion gear formed of a polyamide-imide resin and disposed rearward of said image fixing unit.

37. An image fixing unit according to claim 36, wherein said axial heating means is a heater having uniform heat distribution characteristics.

38. For a xerographic printing and sheet processing apparatus having an image printing apparatus for printing superficially onto a sheet an image developed with magnetic toner from a latent image, an image fixing unit for fixing the superficially printed toner image onto the sheet while transporting the sheet through said image fixing unit, said image fixing unit comprising:

a hollow heating roller terminally carrying a thermally insulating power transmitting element for transmitting rotational power to the heating roller, and a correction collar having thermal insulating properties equivalent to thermal insulating properties of the power transmitting element on an end of said heating roller opposite the power transmitting element; said correction collar having thermal insulating characteristics equivalent to thermal insulating characteristics of the power transmitting element;

bearing means for rotatably supporting said heating roller;

means disposed pressible against said heating roller, for transporting said sheet while nipping said sheet together with said heating roller; and axial heating means disposed concentrically within said heating roller, for heating said heating roller.

39. An image fixing unit according to claim 38, wherein said power transmitting element is a pinion gear formed of a polyamide-imide resin and disposed rearward of said image fixing unit.

40. An image fixing unit according to claim 39, wherein said axial heating means is a heater having uniform heat distribution characteristics.

41. For a xerographic printing and sheet processing apparatus having an image printing apparatus for printing superficially onto a sheet an image developed with magnetic toner from a latent image, an image fixing apparatus, comprising:

fixing means including heating means interiorly incorporating a heat source, for fixing the superficially printed toner image onto the sheet;

a housing formed of a heat-resistant resin, disposed covering said heating means;

a temperature responsive means mounted in said housing; and position staying means for maintaining a predetermined spacing between said temperature responsive means and said heating means in case said housing deforms under thermal stress.

42. An image fixing apparatus according to claim 41, wherein said position staying means is a restraint disposed behind said temperature responsive means and ulterior of said heating means at a predetermined gap from said housing, for preventing said temperature responsive means from becoming displaced relative to said heating means in case said housing deforms under thermal stress due to an abnormal rise in temperature in said fixing means.

43. An image fixing apparatus according to claim 42, wherein said restraint is a cap for covering said housing, formed of a material such that under thermal stress, thermal deformation of said cap is less than thermal deformation of said housing.

44. An image fixing apparatus according to claim 43, wherein said temperature responsive means comprises a thermistor disposed adjacent said heating means, and said cap includes a plurality of ribs;

said cap covering said housing such that the ribs are adjacently behind said thermistor, ulterior of said heating means.

45. An image fixing apparatus according to claim 44, wherein said housing is formed of polybutylene terephthalate, and said cap is formed of polyethylene terephthalate.

46. An image fixing apparatus according to claim 43, wherein said temperature responsive means includes a temperature fuse, and said cap includes a plurality of ribs;

said cap covering said housing such that the ribs are adjacently behind said temperature fuse, ulterior of said heating means.

47. An image fixing apparatus according to claim 46, wherein said housing is formed of polybutylene terephthalate, and said cap is formed of polyethylene terephthalate.

48. An image fixing apparatus according to claim 47, wherein said temperature responsive means further includes a thermistor for detecting surface temperature of said heating means.

49. An image fixing apparatus according to claim 48, wherein said ribs are formed so that when said cap covers said housing, said ribs prevent displacement of said temperature fuse and said thermistor from operative positions thereof.

50. An image fixing apparatus according to claim 41, wherein said temperature responsive means is mounted in a lateral wall of said housing; and said position staying means including a mounting element formed of a shape memory alloy, attached to the lateral wall of said housing, one end of said mounting element supporting said temperature responsive means so that, in case said housing deforms under thermal stress, said mounting element changes shape, such that said predetermined spacing between said temperature responsive means and said heating means is maintained.

51. An image fixing apparatus according to claim 50, wherein said mounting element is formed of said shape memory alloy for maintaining formed configuration at temperature not greater than a heat-resistant temperature of said housing, and for assuming a previously-shaped configuration at temperature above the heat-resistant temperature of said housing.

52. An image fixing apparatus according to claim 51, wherein said temperature responsive means includes a thermistor for detecting surface temperature of said heating means.

53. Sheet transportation apparatus for a xerographic image fixing apparatus, comprising:

a first sheet transport mechanism having a first pair of reciprocally circulating sheet transport surfaces for transporting a sheet nipped therebetween;

a pressuring regulator mechanism for bringing the first pair of sheet transport surfaces into a pressed together state, and for bringing said first pair of sheet transport surfaces into a pressure-released state;

a second sheet transport mechanism having a second pair of reciprocally circulating sheet transport surfaces and disposed adjacent said first transport mechanism in a transport direction of the sheet transportation;

a power train including a drive gear mounted onto said first sheet transport mechanism, a follower gear mounted onto said second sheet transport mechanism, and a middle gear approachable toward and withdrawable from at least one of said drive gear and said follower gear but engageable with both; and a power train controller mechanism for controlling transmission of power to the first and second sheet transport mechanisms, wherein said power train controller mechanism engages said middle gear with said drive gear and said follower gear when said pressuring regulator mechanism brings said first pair of sheet transport surfaces into said pressed together state; and said power train controller mechanism disengages at least one of said drive gear and said follower gear from said middle gear when said pressuring regulator mechanism brings said first pair of sheet transport surfaces into the pressure-released state.

54. Sheet transportation apparatus according to claim 53, wherein said first sheet transport mechanism includes, as a pair of image fixing rollers, a heating roller containing a heater; and a pressure roller pressible against said heating roller.

55. Sheet transportation apparatus according to claim 54, wherein said pressure roller is supported through a bearing and a spring, so that said pressure roller is vertically shiftable and is constantly pressed against said heating roller by said spring.

56. Sheet transportation apparatus according to claim 53, wherein said second sheet transport mechanism includes a pair of discharge rollers.

57. Sheet transportation apparatus according to claim 56, wherein said first sheet transport mechanism includes, as a pair of image fixing rollers, a heating roller containing a heater; and a pressure roller pressible against said heating roller.

58. Sheet transportation apparatus according to claim 57, wherein said pressure roller is supported through a bearing and a spring, so that said pressure roller is vertically shiftable and is constantly pressed against said heating roller by said spring.

59. Sheet transportation apparatus according to claim 58, wherein, in said power train, said drive gear is mounted onto said heating roller, said follower gear is mounted onto one of the discharge rollers, and said middle gear is supported by the bearing such that said middle gear is vertically shiftable and is impelled in a direction engaging said middle gear with said drive gear and said follower gear.

60. Sheet transportation apparatus according to claim 59, further including a release arm medially supported to be turnable, and having a slot in one end for holding an axle of said pressure roller; wherein an opposite end of said release arm abuts on a bearing carrying said middle gear, so that said release arm is turnable parting said middle gear from at least one of said drive gear and said follower gear when said heating roller is separated from said pressure roller.

61. Sheet transportation apparatus for a xerographic image fixing apparatus, comprising:

a first sheet transport mechanism having a first pair of reciprocally circulating sheet transport surfaces for transporting a sheet nipped therebetween;

a pressuring regulator mechanism capable of effecting operations for bringing the first pair of sheet transport surfaces into a pressed together state, and for bringing said first pair of sheet transport surfaces into a pressure-released state;

a second sheet transport mechanism having a second pair of sheet transport surfaces for mutual circulation pressed together, said second pair of sheet transport surfaces being separable from each other; and a linkage mechanism for releasing pressure between said second pair of sheet transport surfaces in conjunction with the operation of said pressuring regulator mechanism for bringing said first pair of sheet transport surfaces into the pressure-released state.

62. Sheet transportation apparatus according to claim 61, wherein said first sheet transport mechanism includes, as a pair of image fixing rollers, a heating roller containing a heater; and a pressure roller pressible against said heating roller.

63. Sheet transportation apparatus according to claim 62, wherein said pressure roller is supported through a bearing and a spring, so that said pressure roller is vertically shiftable and is constantly pressed against said heating roller by said spring.

64. Sheet transportation apparatus according to claim 63, wherein said second sheet transport mechanism includes a pair of discharge rollers.

65. Sheet transportation apparatus according to claim 64, wherein one of said pair of discharge rollers is vertically shiftable and is pressible against the other discharge roller; said sheet transportation apparatus further including a release arm medially supported to be turnable, and having a slot in one end for holding an axle of said pressure roller, and having a corresponding slot in an opposite end for holding an axle of the vertically shiftable one of said pair of discharge rollers, wherein said release arm is turnable parting said pressure roller from said heating roller meanwhile separating said vertically shiftable one of said pair of discharge rollers from the other discharge roller.

* * * * *